US010526122B2

(12) United States Patent
DeRaedt et al.

(10) Patent No.: US 10,526,122 B2
(45) **Date of Patent: *Jan. 7, 2020**

(54) SYSTEM FOR DISPENSING LIQUIDS

(71) Applicant: BAR EVOLUTION LLC, Henderson, NV (US)

(72) Inventors: Peter DeRaedt, Henderson, NV (US); Bernd Witzany, Munich (DE)

(73) Assignee: BAR EVOLUTION LLC, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/265,673

(22) Filed: Feb. 1, 2019

(65) Prior Publication Data

US 2019/0270569 A1 Sep. 5, 2019

Related U.S. Application Data

(63) Continuation of application No. 15/285,307, filed on Oct. 4, 2016, now Pat. No. 10,233,003.
(Continued)

(51) Int. Cl.
*B65D 77/06* (2006.01)
*B65D 25/04* (2006.01)
(Continued)

(52) U.S. Cl.
CPC ..... *B65D 77/068* (2013.01); *B65D 25/04* (2013.01); *B67D 3/0019* (2013.01);
(Continued)

(58) Field of Classification Search
CPC ..... B65D 77/068; B65D 25/04; B65D 25/48; B67D 3/0019; B67D 3/0029;
(Continued)

(56) References Cited

U.S. PATENT DOCUMENTS 3,759,422 A 9/1973 Matheney
3,904,079 A 9/1975 Kross
(Continued)

OTHER PUBLICATIONS

Webpage: http://www.bevmo.com/fireball-whisky-firebox-2-1-75-2-pk-1-75ltr-.html; downloaded from internet on Oct. 4, 2016; 2 pages.

(Continued)

*Primary Examiner* — Nicholas J. Weiss
(74) *Attorney, Agent, or Firm* — Howard & Howard Attorney PLLC

(57) ABSTRACT

A beverage dispensing system for dispensing alcoholic beverages includes a beverage dispensing package and a connector assembly configured to be coupled to the package. The package includes an outer container and at least one divider positioned within the outer container to form a plurality of compartments. The package also includes a plurality of inner containers, with one of the inner containers positioned within each of the compartments. Each inner container stores an alcoholic beverage and each container includes an outlet to enable the alcoholic beverage to be dispensed. The connector assembly includes a plurality of connectors for coupling to a respective outlet of the inner containers, and a dispensing line coupled to the connectors. The connector assembly couples the inner containers in flow communication with the dispensing line to enable the alcoholic beverages within each of the inner containers to be jointly dispensed through the dispensing line.

20 Claims, 27 Drawing Sheets

Related U.S. Application Data

(60) Provisional application No. 62/246,469, filed on Oct. 26, 2015, provisional application No. 62/237,912, filed on Oct. 6, 2015.

(51) Int. Cl.
*B67D 3/00* (2006.01)
*B65D 25/48* (2006.01)

(52) U.S. Cl.
CPC ..... *B67D 3/0029* (2013.01); *B65D 25/48* (2013.01); *B67D 3/0006* (2013.01); *B67D 2210/0006* (2013.01); *B67D 2210/00062* (2013.01); *B67D 2210/00091* (2013.01)

(58) Field of Classification Search
CPC ..... B67D 3/0006; B67D 2210/0006; B67D 2210/00062; B67D 2210/00091
See application file for complete search history.

(56) References Cited

U.S. PATENT DOCUMENTS

| | | | | |
|---|---|---|---|---|
| 4,687,120 | A | 8/1987 | McMillin | |
| 4,898,303 | A | 2/1990 | Large et al. | |
| 4,913,316 | A | 4/1990 | Richter | |
| 5,750,216 | A | 5/1998 | Horino et al. | |
| 6,202,878 | B1 * | 3/2001 | Cook | B01L 1/00 215/247 |
| 7,197,377 | B2 | 3/2007 | Knepler | |
| 8,894,599 | B2 | 11/2014 | Kataria | |
| 8,952,784 | B2 | 2/2015 | Katerberg et al. | |
| 9,056,759 | B2 | 6/2015 | Hourmand et al. | |
| 2008/0314927 | A1 | 12/2008 | Martin | |
| 2009/0277516 | A1 | 11/2009 | Winkler et al. | |

OTHER PUBLICATIONS

International Search Report and Written Opinion (International Application No. PCT/US16/55330); dated Dec. 30, 2016; 9 pages.

* cited by examiner

SYSTEM FOR DISPENSING LIQUIDS

CROSS-REFERENCE TO RELATED APPLICATIONS

The present application is a continuation of U.S. patent application Ser. No. 15/285,307, filed Oct. 4, 2016, which claims the benefit of U.S. Provisional Patent Application Ser. No. 62/237,912, filed Oct. 6, 2015, and U.S. Provisional Patent Application Ser. No. 62/246,469, filed Oct. 26, 2015, the entire disclosures of which are hereby incorporated by reference.

FIELD OF THE DISCLOSURE

The present disclosure relates generally to beverage dispensing solutions, and more specifically, to systems for dispensing alcoholic beverages.

BACKGROUND

Regulations vary from country to country on how distilled spirits can be distributed, not only the volume but also packaging, labeling, filling, etc. In the United States, the Department of Treasury Alcohol & Tobacco Tax & Trade Bureau (TTB) regulates the bottle sizes for distilled spirits. Further, the Internal Revenue Code of 1986 authorizes regulations on the kind and size of containers for distilled spirits. According to the TTB, the purpose of the regulations establishing uniform standards of fill for alcoholic beverages is "to prevent a proliferation of bottle sizes and shapes which would inevitably result in consumer confusion and deception with regard to the quantity and net contents of the alcohol beverage package." In addition, the "uniformity in bottle sizes required by these standards also facilitates the proper calculation of Federal excise tax." A key issue related to these concepts is the potential loss of water and the resulting increase in alcohol concentration or "proof" which may be affected by the packaging.

The maximum volume of packaging of spirits may be limited in some jurisdictions. For example, in the United States, the maximum volume of packaging that spirits can be shipped or distributed in is currently 1.75 liters. This limitation has a significant impact for places where spirits are distributed or consumed in large quantities such as clubs, large events, bars, conferences, etc.

The current way to address this regulatory restriction is to create pump rooms filled with racks in which bottles are turned upside down and collectors channel the liquid through tubes to pumps and ultimately, to the dispending device(s). This multiplies the capacity of a specific distilled spirit by the number of bottles used. However, this method requires significant real estate to support the bars in the property. It further has an impact on labor, space, weight, time and also the disposal process that generates a lot of waste. As a result, this solution creates significant inefficiencies.

The present disclosure is aimed at solving one or more of the problems identified above.

SUMMARY

In one embodiment, a beverage dispensing system for dispensing alcoholic beverages includes a beverage dispensing package and a connector assembly configured to be coupled to the beverage dispensing package. The beverage dispensing package includes an outer container, at least one divider positioned within the outer container to form a plurality of compartments, and a plurality of inner containers. One of the plurality of inner containers is positioned within each of the plurality of compartments, and each inner container is configured to store an alcoholic beverage. Each inner container includes an outlet to enable the alcoholic beverage to be dispensed. The connector assembly includes a plurality of connectors configured to couple to a respective outlet of the plurality of inner containers and a dispensing line coupled to the plurality of connectors. When the connector assembly is coupled to the beverage dispensing package, the plurality of inner containers are coupled in flow communication with the dispensing line to enable the alcoholic beverages within each of the inner containers to be jointly dispensed through the dispensing line.

In another embodiment, a connector assembly is configured to be coupled to an alcoholic beverage dispensing package having a plurality of outlets for dispensing alcoholic beverages stored within a plurality of inner containers. The connector assembly includes a plurality of connectors configured to couple to a respective outlet of the plurality of inner containers and a dispensing line coupled to the plurality of connectors. The dispensing line enables each connector to be in flow communication with each other connector. When the connector assembly is coupled to the beverage dispensing package, the inner containers are coupled in flow communication with the dispensing line to enable the alcoholic beverages within each of the inner containers to be jointly dispensed through the dispensing line.

A beverage dispensing package for dispensing alcoholic beverages includes an outer container and at least one divider positioned within the outer container to form a plurality of compartments. Each compartment is configured to hold an alcoholic beverage container storing an alcoholic beverage. Each alcoholic beverage container includes an outlet to enable the alcoholic beverage to be dispensed. Each outlet is separated from each other outlet such that the alcoholic beverage storable within each alcoholic beverage container is separated from each other alcoholic beverage until a connector assembly is coupled to the beverage dispensing package. The beverage dispensing package also includes an alignment plate, including a plurality of outlet openings. Each outlet opening is configured to receive the outlet of a respective alcoholic beverage container.

BRIEF DESCRIPTION OF THE DRAWINGS

Advantages of the present disclosure will be readily appreciated, as the same becomes better understood by reference to the following detailed description, when considered in connection with the accompanying drawings. Non-limiting and non-exhaustive embodiments of the present disclosure are described with reference to the following figures, wherein like numerals refer to like parts throughout the various views unless otherwise specified.

DETAILED DESCRIPTION

Figure 1:
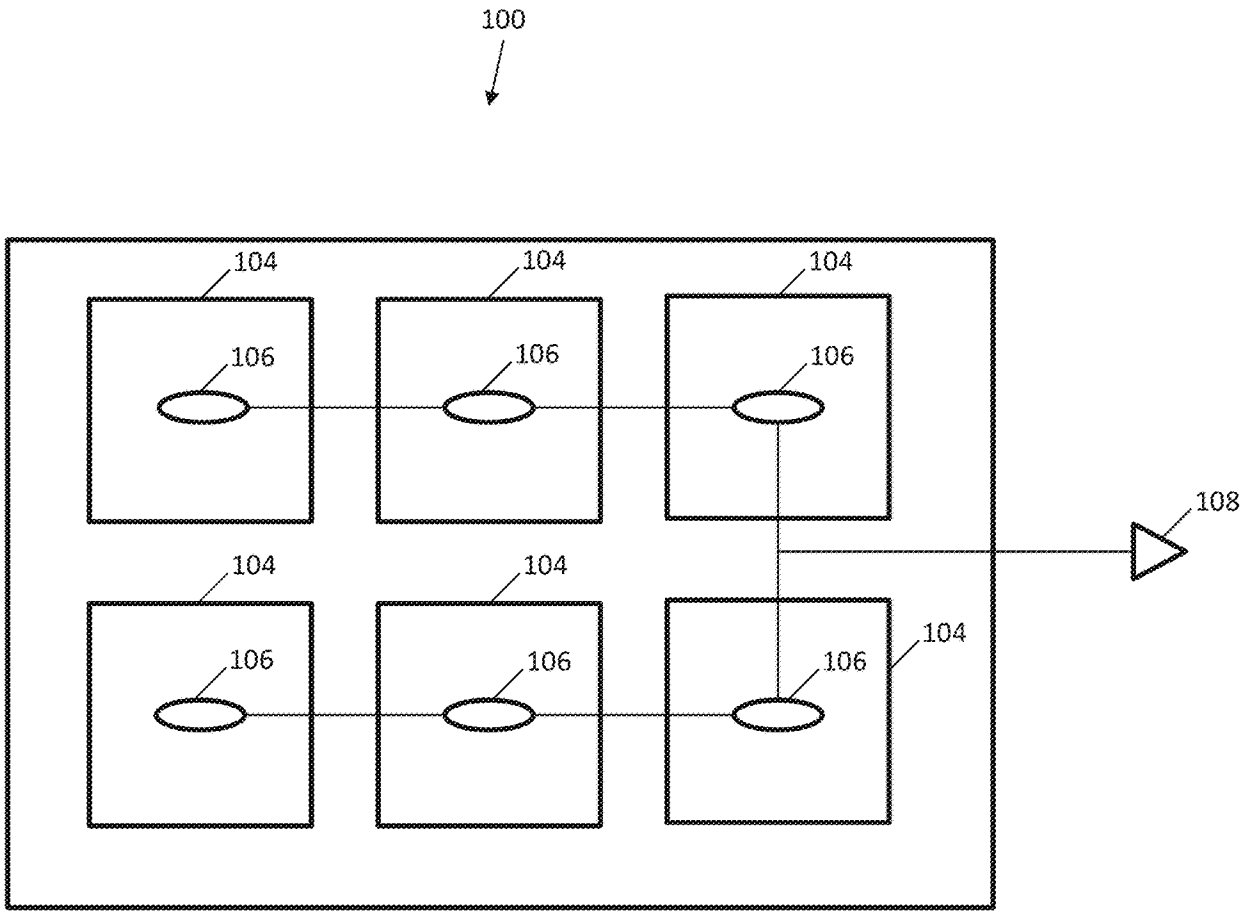
FIG. 1 is a block diagram of a beverage dispensing system that may be used to dispense alcoholic beverages.

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment of example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The present disclosure particularly describes exemplary beverage dispensing systems and packages (e.g., boxes) that may be used to dispense alcoholic beverages. As used herein, the term "alcoholic beverages" refers to any beverage or liquid with alcoholic content that is meant for human consumption.

The boxes include one or more dividers that form two or more compartments within each box. Each compartment is designed to hold an inner container (e.g., a bag) which holds an alcoholic beverage. Each bag includes an outlet for dispensing the alcoholic beverage and a fitment that is attached to the outlet. Each outlet is separated from each other outlet so that the contents of each bag do not mix or flow together until a connector assembly is attached. An alignment plate aligns the fitments of the bags in preparation for attaching to the connector assembly.

A connector assembly is configured to attach to the alignment plate and to the fitments of each bag. The connector assembly includes a connector aligned with each fitment. The connector assembly also includes a holding plate, an actuator plate, a locking member, and a plurality of spring members. The connectors are connected together and are configured to jointly direct liquids from the bags to a common main outlet.

As is described more fully herein, the components of the connector assembly (e.g., the holding plate, the actuator plate, the locking member, and the spring members) cooperate together to enable a user to quickly and accurately attach the connector assembly to the alignment plate and fitments when the user prepares the beverage dispensing system for use. The components of the connector assembly also cooperate together to enable the user to quickly and efficiently disengage the connector assembly from the alignment plate and fitments, for example, when the user wishes to replace empty bags or boxes with filled replacement bags or boxes.

The embodiments described herein comply with the Department of Treasury Alcohol & Tobacco Tax & Trade Bureau (TTB) regulations in that the alcoholic beverages contained in the bags are shipped in a "divorced" state (i.e., the outlets of the bags are not connected together) so that each bag is a self-contained bag that may hold the maximum amount of an alcoholic beverage. The embodiments also enable significant efficiencies to be realized for distributors and end users of the alcoholic beverages. For example, larger quantities of alcoholic beverages may be shipped to a destination and may be efficiently and conveniently prepared for use as compared to prior art systems where individual bottles of alcoholic beverages are shipped. In one example, according to an embodiment described herein, a box may include four bags that each holds up to a maximum allowable volume, e.g., 1.75 liters of an alcoholic beverage. Accordingly, a single box may include 7 liters of an alcoholic beverage that is able to be quickly attached to a connector assembly for dispensing at an end user location. Other boxes may be used with other suitable numbers of bags to enable distributors to have a wide variety of options in the amount of alcoholic beverages to include within a box. For example, boxes with 6 or 8 bags (or any suitable number) may be used to provide 10.5 liters or 14 liters of alcoholic beverages (or any suitable amount) as desired.

FIG. 1 is a block diagram of an exemplary beverage dispensing system 100 that may be used to dispense liquids, such as alcoholic beverages. In one embodiment, beverage dispensing system 100 is a bartender station (or is included therein) at a bar. Alternatively, beverage dispensing system 100 may be used with, or incorporated within, any suitable location such as a kitchen, a bar, a reception area, or may be a portable station that may be used to serve alcoholic beverages in any suitable location.

In one embodiment, beverage dispensing system 100 includes a cabinet or housing 102 and a plurality of beverage dispensing packages 104 positioned within housing 102. Beverage dispensing system 100 may be placed in a bar, a kitchen, or in any other suitable location to enable a user to dispense alcoholic beverages from system 100. For example, a bartender may use beverage dispensing system 100 to dispense alcoholic beverages from each of the beverage dispensing packages 104 during operation.

In one embodiment, each beverage dispensing package 104 is a box or other suitable container that includes a plurality of beverage dispensing bags, for example. Each bag is designed to hold 1.75 liters of alcoholic beverage in order to comply with applicable regulations. Each beverage dispensing package 104 includes an associated connector assembly 106 coupled thereto for dispensing the contents of the bags. For clarity of description, beverage dispensing packages 104 may be referred to herein as boxes 104, although it should be recognized that beverage dispensing packages 104 may be any suitable container other than a box. Similarly, for clarity of description, boxes 104 are described as including a plurality of beverage dispensing bags (or "bags"). However, it should be recognized that any suitable internal containers may be used instead of bags.

In one embodiment, an outlet of each connector assembly 106 may be connected together to form a common outlet line connected to a nozzle 108 or other suitable component for dispensing the contents of the bags. Alternatively, the outlet of each connector assembly 106 may be connected to a separate nozzle 108 so that the contents of the bags within a box 104 may be dispensed separately from the contents of the bags within each other box 104.

Figure 2:
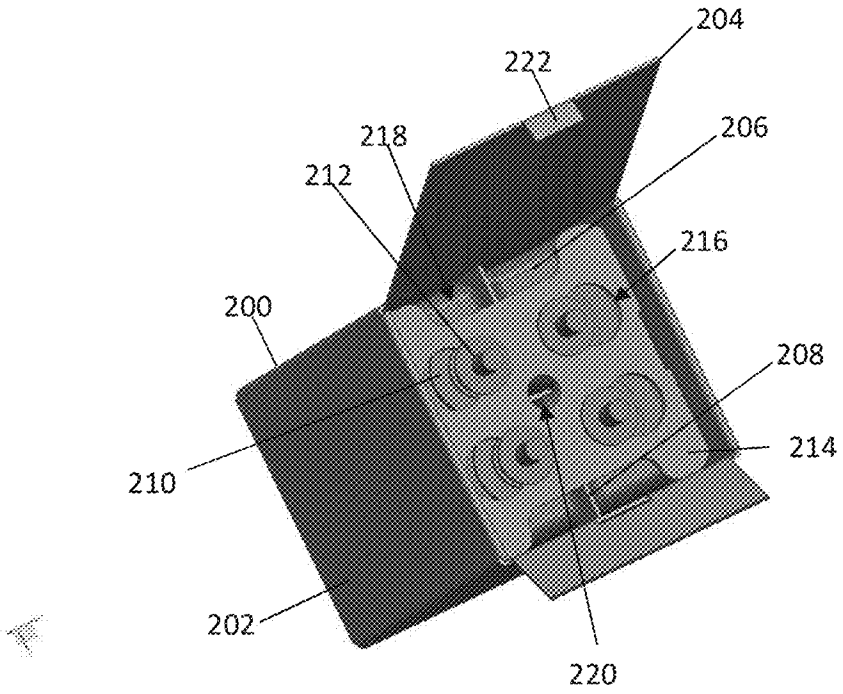
FIG. 2 is a perspective view of an exemplary beverage dispensing package that may be used with the beverage dispensing system shown in FIG. 1.

FIG. 2 is a perspective view of an exemplary beverage dispensing package 200, such as a box 200, that may be used with beverage dispensing system 100 (shown in FIG. 1). While package 200 is described herein as a box, it should be recognized that any suitable package or container may be used.

In an exemplary embodiment, box 200 is a cardboard box that includes sides 202 and a top cover 204. Top cover 204 is movable to expose or to cover a plurality of compartments (not shown in FIG. 2) that include a plurality of inner containers, such as beverage dispensing bags 206. The compartments are formed by one or more dividers 208 positioned within box 200.

In an exemplary embodiment, two dividers 208 are positioned within box 200 to form four substantially equally sized and shaped compartments. More specifically, in the exemplary embodiment, each compartment has a square-shaped cross-section that houses a respective bag 206 that also has a substantially square-shaped cross-section. Alternatively, any suitable number and shape of compartments and bags 206 may be used with box 200. In addition to creating compartments within box 200, dividers 208 provide stability and support to box 200.

Each bag 206 includes an outlet (not shown in FIG. 2) that enables liquid (e.g., an alcoholic beverage) to be dispensed from bag 206. A container fitment 210 or another suitable connector is securely fit onto each outlet to enable the outlet of each bag 206 to be releasably coupled to a connector assembly. Accordingly, in the exemplary embodiment, each outlet is initially separated from each other outlet until the connector assembly is attached to the outlets. In this manner, the outlets of each bag 206 may be transported in a "divorced" manner (i.e., not in fluid communication with each other) to satisfy applicable governmental regulations and may then be connected together by a connector assembly at the final destination to provide one common fluid dispensing line that dispenses the contents of each bag through the common dispensing line.

In one embodiment, each fitment 210 includes a removable cap 212 that prevents the contents of each bag 206 from spilling or leaking out during transport. Caps 212 also may be included for health reasons, for example, to prevent contamination of fitments 210. In a more specific embodiment, each cap 212 may be glued or otherwise attached to top cover 204 of box 200 during shipping so that when a user opens top cover 204, each cap 212 will be automatically removed to expose the fitments of each bag 206. Alternatively, caps 212 may be connected together by a string or another suitable connection to enable a user to quickly remove all caps 212 at the same time or in quick succession. In one embodiment, caps 212 may be used to visibly determine whether bags 206 or fitments 210 have been tampered with or opened. For example, caps 212 may have a detachable ring or another suitable portion that may detach from caps 212 when caps 212 are first removed. Accordingly, a user may determine that caps 212 have been removed or fitments 210 have otherwise been tampered with by determining whether the ring (or other portion) of caps 212 is no longer attached. Alternatively, a seal (not shown) that is removable, penetrable, or may be broken, to facilitate or allow alcohol to flow, may be used. Other suitable indicators may be used to determine whether caps 212 have been removed or tampered with in other embodiments.

In one embodiment, an alignment plate 214 is coupled to a top portion of box 200 and is secured to box 200 by two or more latches (not shown) on opposing sides of alignment plate 214. Alignment plate 214 includes a plurality of fitment openings 216 to enable the outlets of each bag 206 to extend through alignment plate 214. Alignment plate 214 also includes two or more grip openings 218 to enable a user to grasp a portion of alignment plate 214 when attaching a connector assembly to alignment plate 214 and bags 206. Alignment plate 214 also includes a locking member opening 220 for receiving a locking member to removably attach alignment plate 214 to the connector assembly.

In one embodiment, alignment plate 214 is transparent to enable a user to view bags 206 underneath alignment plate 214. In a further embodiment, bags 206 are transparent to enable a user to view the contents of bag 206 and/or a fill level of bags 206.

In one embodiment, top cover 204 is foldable or otherwise movable to either cover, or expose the top portion of box 200. For example, top cover 204 may be folded down into a closed position for shipping or transport. Additionally or alternatively, top cover 204 may be removable by a user to expose the top portion of box 200. For example, top cover 204 may be removably attached to box 200 by a perforated or pre-scored hinge that a user may tear off to remove top cover 204. In the closed position, top cover 204 hides alignment plate 214 and fitments 210 from view and protects alignment plate 214 and fitments 210 during transport. Top cover 204 may be latched in the secured position by a tab or latch 222. Top cover 204 may also be removed or folded up into an open position when a user wants to access fitments 210 or alignment plate 214, for example, in preparation for dispensing the contents of bags 206.

Figure 3:
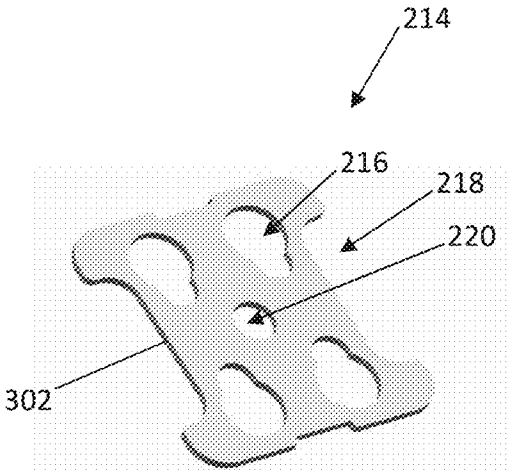
FIG. 3 is a perspective view of an exemplary alignment plate that may be used with the beverage dispensing package shown in FIG. 2.

FIG. 3 is a perspective view of alignment plate 214 that may be used with beverage dispensing package 200 (shown in FIG. 2).

In an exemplary embodiment, alignment plate 214 includes a plurality of fitment openings 216 and a locking member opening 220. In one embodiment, fitment openings 216 are key-hole shaped to enable fitments 210 of each bag 206 to be easily inserted (through the larger portion of each opening 216) and to enable fitments 210 to be secured in a final attachment position (the smaller portion of each opening 216) to facilitate coupling fitments 210 to the connector assembly. Alternatively, fitment openings 216 may have any suitable shape.

Locking member opening 220 is shaped to receive a portion of a locking member of the connector assembly. In one embodiment, locking member opening 220 is circular. Alternatively, locking member opening 220 may be any suitable shape.

Alignment plate 214 also includes two grip openings 218 defined therein to enable a user to grasp a grip portion 302 of alignment plate 214. While two grip openings 218 are shown in FIG. 3, it should be recognized that any suitable number of grip openings 218 may be formed in alignment plate 214.

Figure 4:
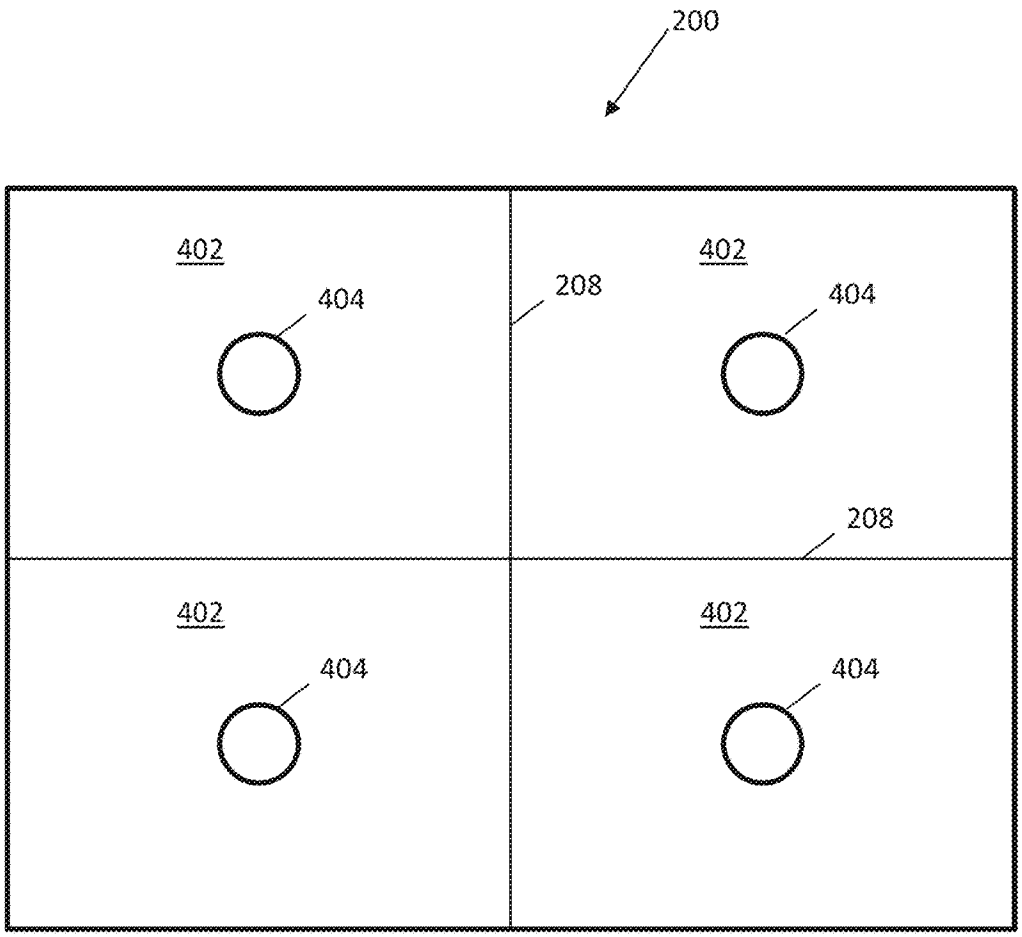
FIG. 4 is a block diagram showing a top view of the beverage dispensing package of FIG. 2 with an alignment plate and fitment caps removed.

FIG. 4 is a block diagram showing a top view of beverage dispensing package 200 (e.g., box 200) with alignment plate 214 and caps 212 removed. As illustrated in FIG. 4, box 200 may include a plurality of dividers 208 that form a plurality of compartments 402 within box 200. While two dividers 208 are shown as forming four compartments 402, it should be recognized that any suitable number of dividers 208 and compartments 402 may be included within each box 200.

In an exemplary embodiment, a separate bag 206 is positioned within each compartment 402. Each bag 206 includes a respective outlet 404 for dispensing the contents of bag 206 (e.g., alcoholic beverages). Each outlet 404 is separated from each other so that the outlets 404 (and therefore, the contents of each bag 206) are not in fluid communication with each other. This is sometimes referred to as being in a "divorced" state.

As illustrated in FIG. 4, box 200, compartments 402, and bags 206 may have a substantially square or rectangular cross-section to enable bags 206 and boxes 200 to be stacked on top of each other during transport or during operation (i.e., during the dispensing of the alcoholic beverages). Alternatively, boxes 200, compartments 402, and bags 206 may have any suitable shape or cross-section as desired. Further examples of box 200, compartments 402, and bag 206 shapes are illustrated in FIGS. 5 and 6A-6D.

Figure 5:
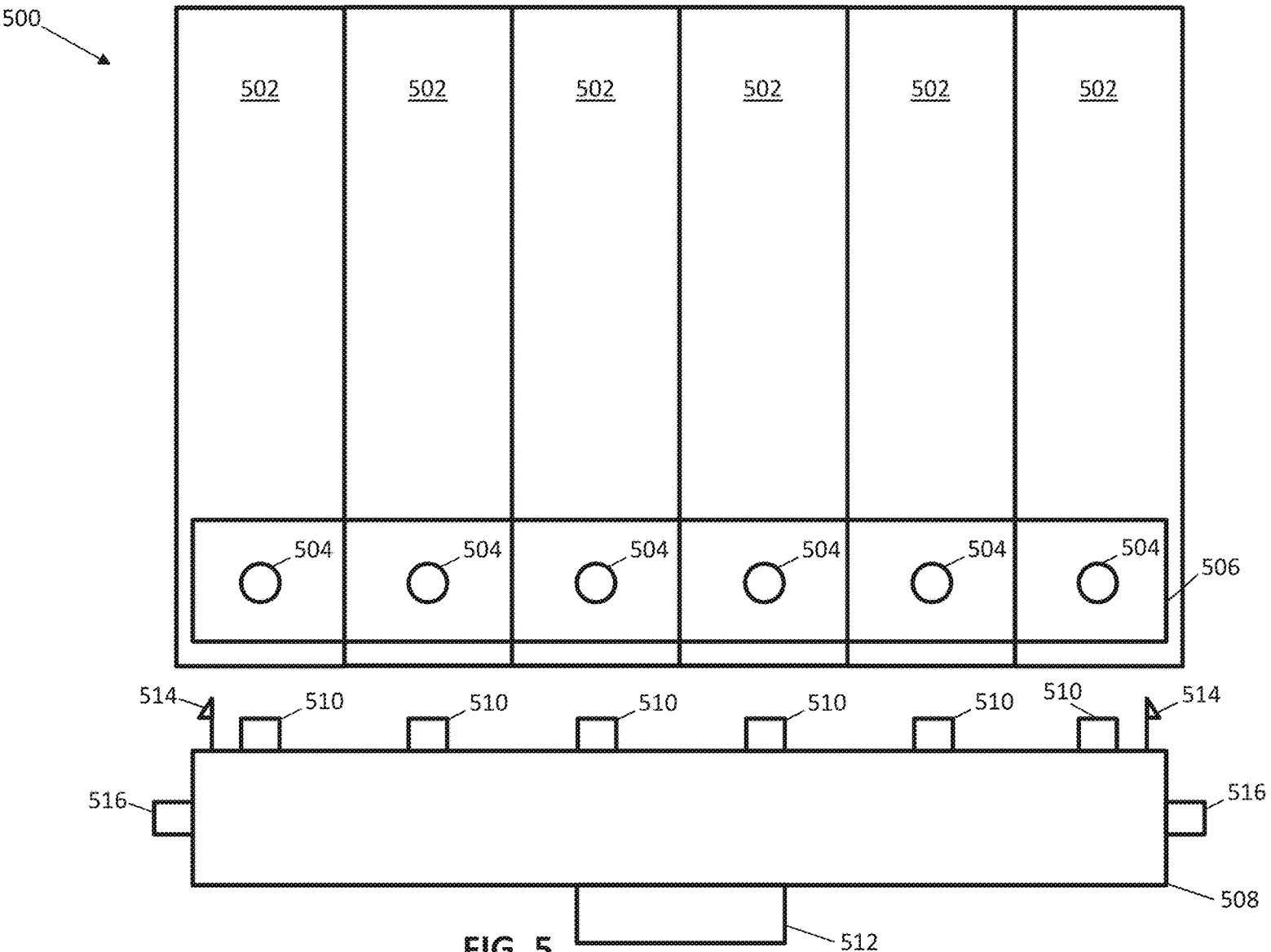
FIG. 5 illustrates an alternative embodiment of a beverage dispensing package having elongated rectangular compartments that may be used with the beverage dispensing system shown in FIG. 1.

FIG. 5 illustrates an alternative embodiment of a box 500 having elongated rectangular compartments 502 that may be used with beverage dispensing system 100 (shown in FIG. 1). While six rectangular compartments 502 are illustrated in FIG. 5, any suitable number and shape of compartments 502 may be used with box 500.

In the embodiment shown in FIG. 5, a bag (not shown) having a rectangular cross-section is placed within each compartment, and an outlet 504 of each bag is positioned near a bottom portion of each compartment 502. Alternatively, outlets 504 may be positioned in any suitable location with respect to the bags or compartments 502. A rectangular alignment plate 506 is coupled to the bags and outlets 504 in a similar manner as described above with reference to FIGS. 2 and 3.

A connector assembly 508 is removably attachable to alignment plate 506. Connector assembly 508 includes a plurality of connectors 510, with each connector 510 aligned with a respective outlet 504 when outlets 504 are positioned within alignment plate 506. The connectors 510 are in flow communication with a main outlet 512 of connector assembly 508. Accordingly, when connector assembly 508 is attached to alignment plate 506, the bags are coupled in flow communication with main outlet 512 through each bag outlet 504 and through the respective connectors 510. The contents of each bag are therefore enabled to jointly and simultaneously flow together through connector assembly 508 and be dispensed out of main outlet 512.

In one embodiment, connector assembly 508 is removably attached to alignment plate 506 by one or more latches 514 that engage a portion of alignment plate 506 and/or box 500. One or more buttons 516 are provided in connector assembly 508 that release latches 514 when buttons 516 are pressed by a user to enable connector assembly 508 to detach from alignment plate 506 and box 500.

Figure 6A:
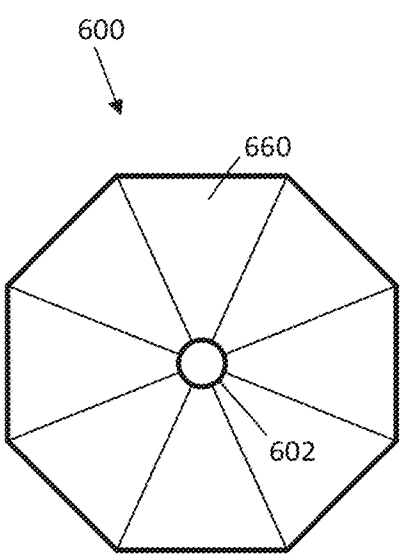
FIGS. 6A-6D illustrate alternative beverage dispensing packages and associated containers that may be used with the beverage dispensing system shown in FIG. 1.
Figure 6B:
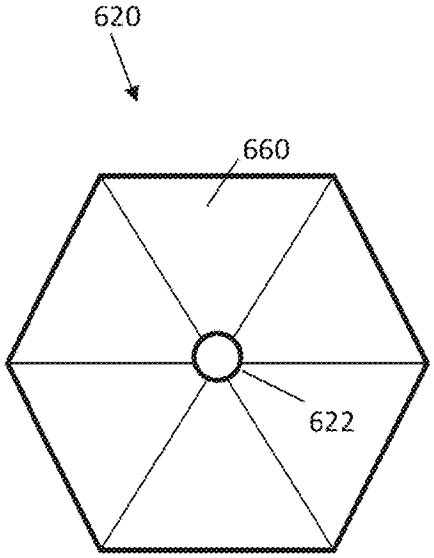
Figure 6C:
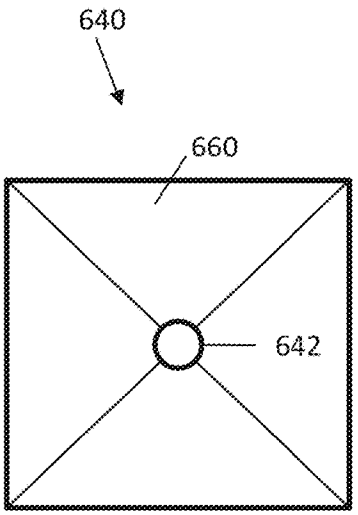
Figure 6D:
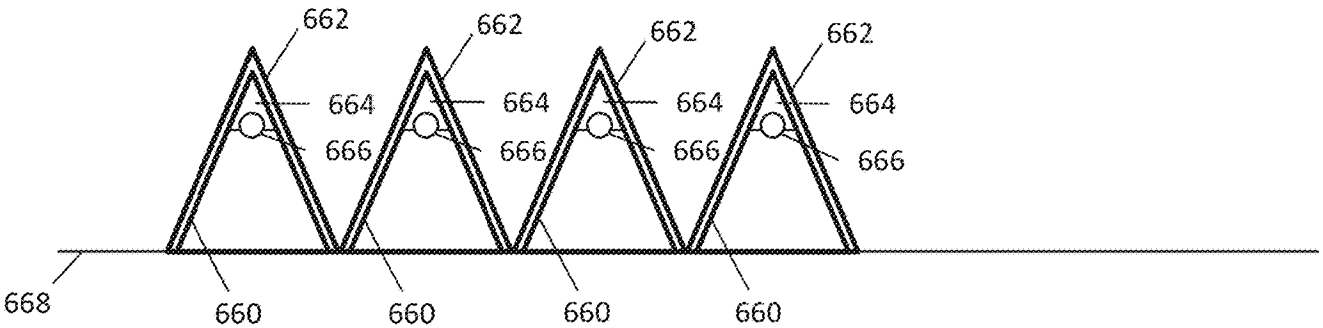

FIGS. 6A-6D illustrate alternative boxes and associated bags that may be used with beverage dispensing system 100 (shown in FIG. 1). FIG. 6A is a block diagram of a substantially octagonal box 600. FIG. 6B is a block diagram of a substantially hexagonal box 620. FIG. 6C is a block diagram of a substantially square box 640. FIG. 6D illustrates bags 660 having a substantially triangular cross-section that may be used with the boxes shown in FIGS. 6A-6C.

Referring to FIG. 6A, octagonal box 600 includes eight bags 660 having a triangular cross-section. A common outlet 602 is positioned in the center of box 600 and is connected to respective outlets (shown in FIG. 6D) of each bag 660.

Referring to FIG. 6B, hexagonal box 620 includes six bags 660 having a triangular cross-section. A common outlet 622 is positioned in the center of box 620 and is connected to respective outlets (shown in FIG. 6D) of each bag 660.

Referring to FIG. 6C, square box 640 includes four bags 660 having a triangular cross-section. Similar to the embodiments of 6A and 6B, a common outlet 642 is positioned in the center of box 640 and is connected to respective outlets (shown in FIG. 6D) of each bag 660.

Referring to FIG. 6D, a plurality of bags 660 having a triangular cross-section may be used with the boxes shown in FIGS. 6A-6C. Bags 660 may be housed or positioned within an intermediate container 662 that also has a triangular cross-section. Each bag 660 includes an alignment portion 664 that may be used to align a respective outlet 666 with the common outlet of the box shown in FIG. 6A, 6B, or 6C.

Each intermediate container 662 may be coupled to a common edge 668 that may form the exterior of the box. For example, in one embodiment, each intermediate container 662 is coupled to a common piece of cardboard that may be folded to form the box. Thus, if four intermediate containers 662 and associated bags 660 are provided, containers 662 may be folded along edge 668 to form the square box shown in FIG. 6C. It should be recognized that other suitable shapes may be used for intermediate containers 662 and bags 660 to form a box of any suitable shape and size. It should also be recognized that intermediate containers 662 may be connected together along different edges to form boxes of any desired shape and configuration.

In one embodiment, the bags of the boxes described in FIGS. 6A-6C may be covered by a removable portion of the respective box. For example, in one embodiment, the box may include one or more tear-away portions or sides that may be pulled away from the bags by a user to reveal the bags and/or outlets.

FIGS. 7-15 illustrate components of a first embodiment of an integrated beverage dispensing system, including a beverage dispensing package and an associated connector assembly.

FIGS. 16-23 illustrate components of a second embodiment of an integrated beverage dispensing system, including a beverage dispensing package and an associated connector assembly.

Figure 24:
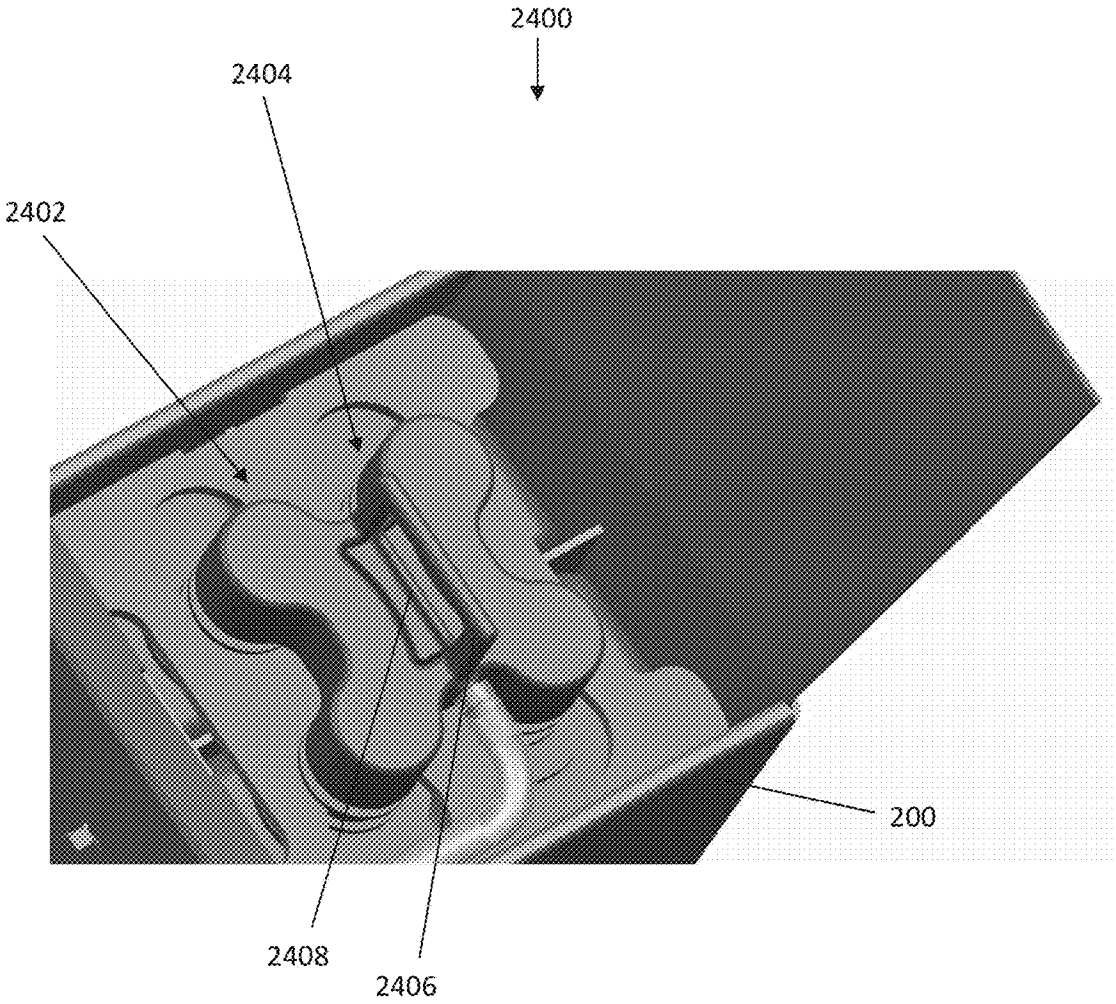
FIG. 24 is a perspective view of another beverage dispensing system.

FIG. 24 illustrates a third embodiment of an integrated beverage dispensing system, including a beverage dispensing package and an associated connector assembly.

Figure 7:
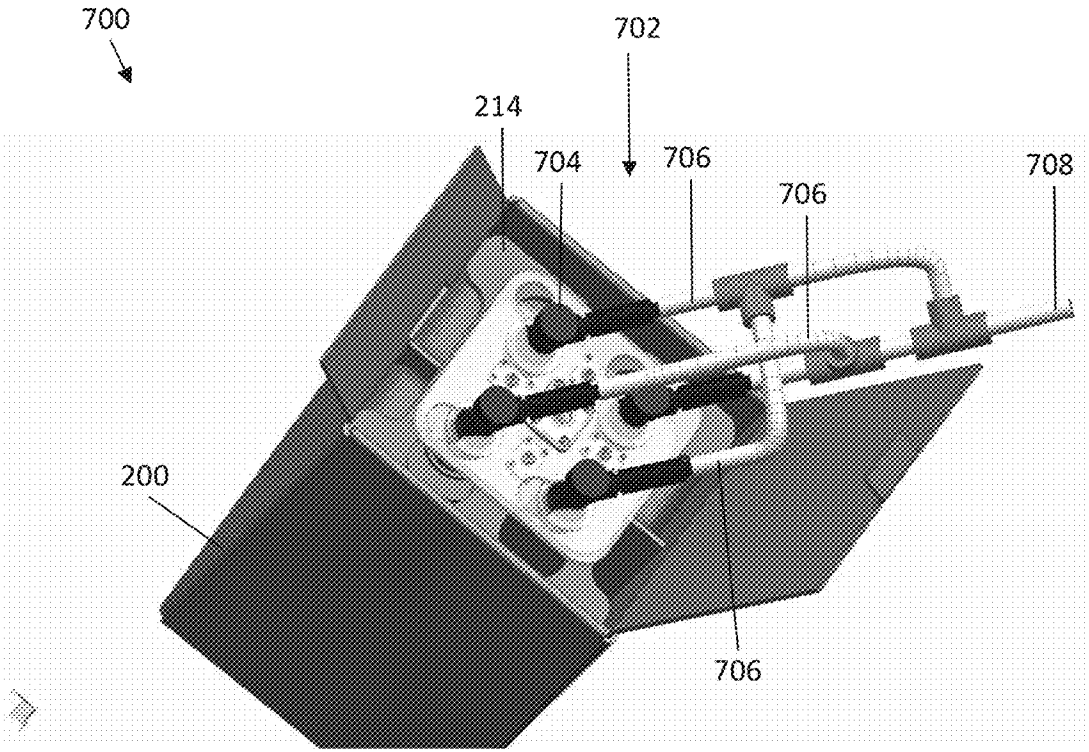
FIG. 7 is a perspective view of a beverage dispensing system.

Referring to FIG. 7, a perspective view of a first embodiment of a beverage dispensing system 700 is illustrated. Beverage dispensing system 700 includes beverage dispensing package 200 (e.g., a box 200) and a connector assembly 702 that is removably coupled to box 200.

In an exemplary embodiment, box 200 includes four bags positioned within four compartments created by two dividers. Alternatively, any suitable number of compartments, bags, and dividers may be used with box 200. In addition, box 200 includes an alignment plate 214 and fitments 210 described above with reference to FIGS. 2 and 3.

Connector assembly 702 includes a plurality of connectors 704 that correspond to fitments 210. Each connector 704 is aligned and sized to enable an insertion portion (not shown) of connector 704 to be inserted within a respective fitment 210 when cap 212 of fitment 210 is removed. Each connector 704 may be connected to an intermediate dispensing line 706, and each intermediate dispensing line 706 may be connected to a main dispensing line 708. Alternatively, connectors 704 may be connected directly to main dispensing line 708 using a single adapter that connects all connectors 704 to main dispensing line 708. When connectors 704 are connected to fitments 210 and to intermediate dispensing lines 706 and main dispensing line 708, a flow communication is established from bags 206 to main dispensing line 708 through bag outlets 404, fitments 210, connectors 704, and intermediate lines 706.

Figure 8:
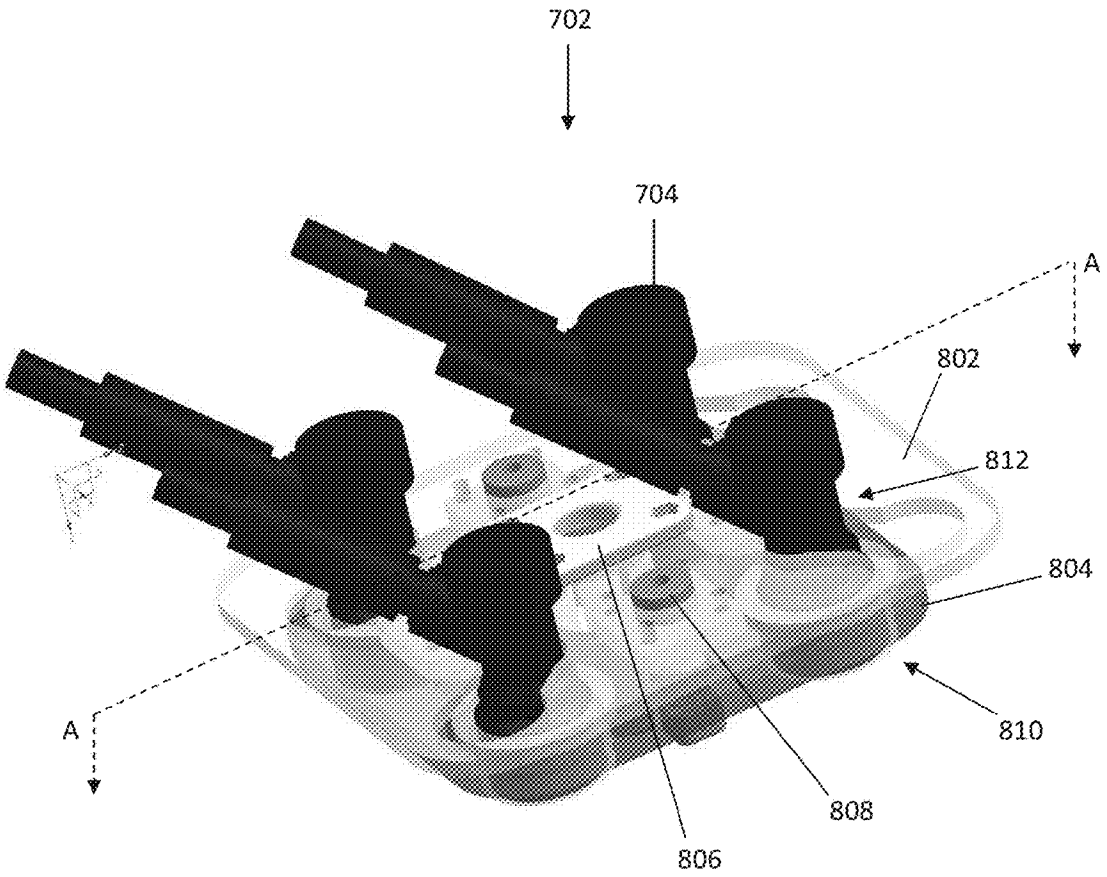
FIG. 8 is a perspective view of a connector assembly that may be used with the beverage dispensing system shown in FIG. 7.
Figure 9:
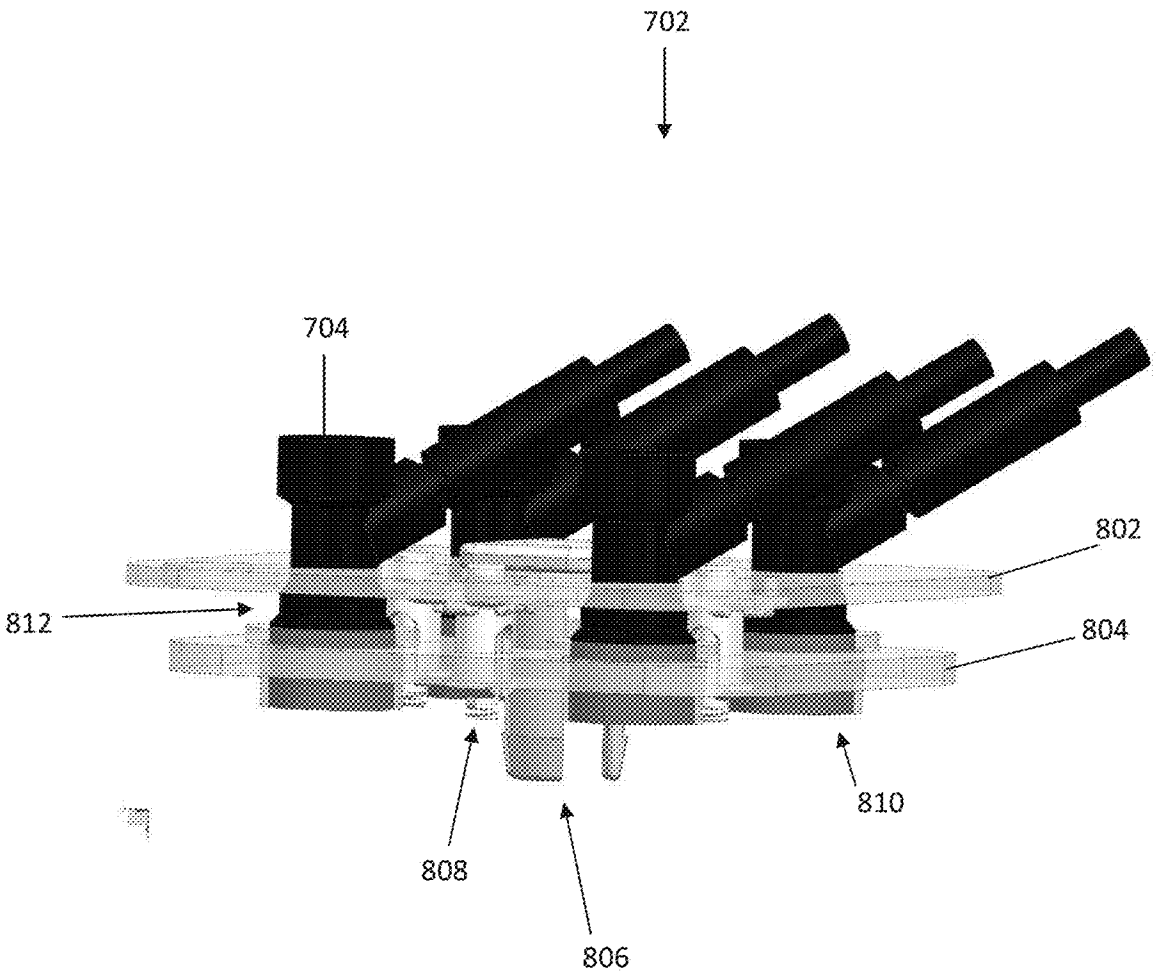
FIG. 9 illustrates a side view of the connector assembly shown in FIG. 8.

Referring to FIG. 8, a perspective view of connector assembly 702 is illustrated. FIG. 9 illustrates a side view of connector assembly 702. As illustrated in FIGS. 8 and 9, connector assembly 702 includes connectors 704, a holding plate 802, an actuator plate 804, a locking member 806, and a plurality of spring members 808. Holding plate 802, actuator plate 804, locking member 806, and spring members 808 are illustrated and described with reference to FIGS. 10-13.

In an exemplary embodiment, connectors 704 are coupled to holding plate 802 and a portion of each connector 704 extends through respective openings defined in holding plate 802 and actuator plate 804. Each connector 704, in this embodiment, is a ball lock "push-pull" connector that includes a movable portion that is able to be selectably connected to fitments 210 or disconnected from fitments 210. More specifically, when connector assembly 702 is ready to be connected to alignment plate 214 and fitments 210, a movable sleeve 810 of connector 704 is pulled toward a main body 812 of connector 704 to prepare connector 704 for attachment. Movable sleeve 810 is then pushed away from main body 812, for example, by a spring (not shown) or another suitable biasing member within connector 704, once connector 704 is attached to fitment 210 to lock connector 704 to fitment 210. When connector assembly 702 is disengaged from actuator plate 804 and outlets 404, movable sleeve 810 is again pulled toward main body 812 to release connector 704 from fitment 210.

Figure 10:
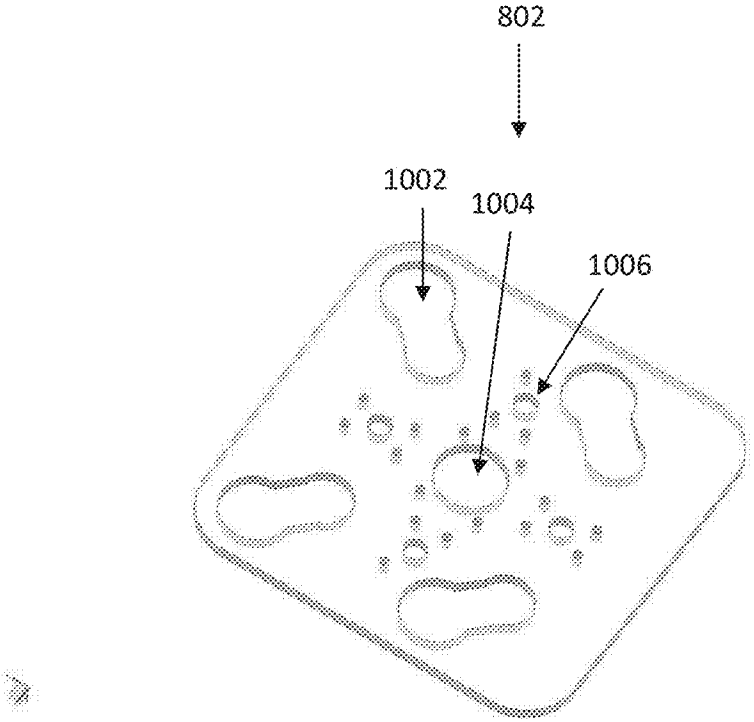
FIG. 10 is a top view of a holding plate that may be used with the beverage dispensing system shown in FIG. 7.

Referring to FIG. 10, a top view of holding plate 802 is illustrated. In an exemplary embodiment, each connector 704, locking member 806, and spring member 808 is coupled to holding plate 802.

In an exemplary embodiment, holding plate 802 includes a connector opening 1002 for each connector 704 to enable connector 704 to extend through the respective opening 1002 and thus, through holding plate 802. In an exemplary embodiment, each connector opening 1002 is shaped as a keyhole shape to facilitate attaching and aligning connectors 704 to holding plate 802. Holding plate 802 also includes a locking member opening 1004 through which locking member 806 extends.

In an exemplary embodiment, holding plate 802 also includes a plurality of spring member openings 1006 that enable a respective spring member 808 to extend through each opening 1006.

Holding plate 802 is designed to hold connectors 704 in place when attaching connector assembly 702 to alignment plate 214 (and thus box 200) and when removing connector assembly 702 from alignment plate 214 and box 200. In addition, holding plate 802 provides a secure and stable support that a user may grasp, push, and pull (as appropriate) when connecting and disconnecting connector assembly 702.

Figure 11:
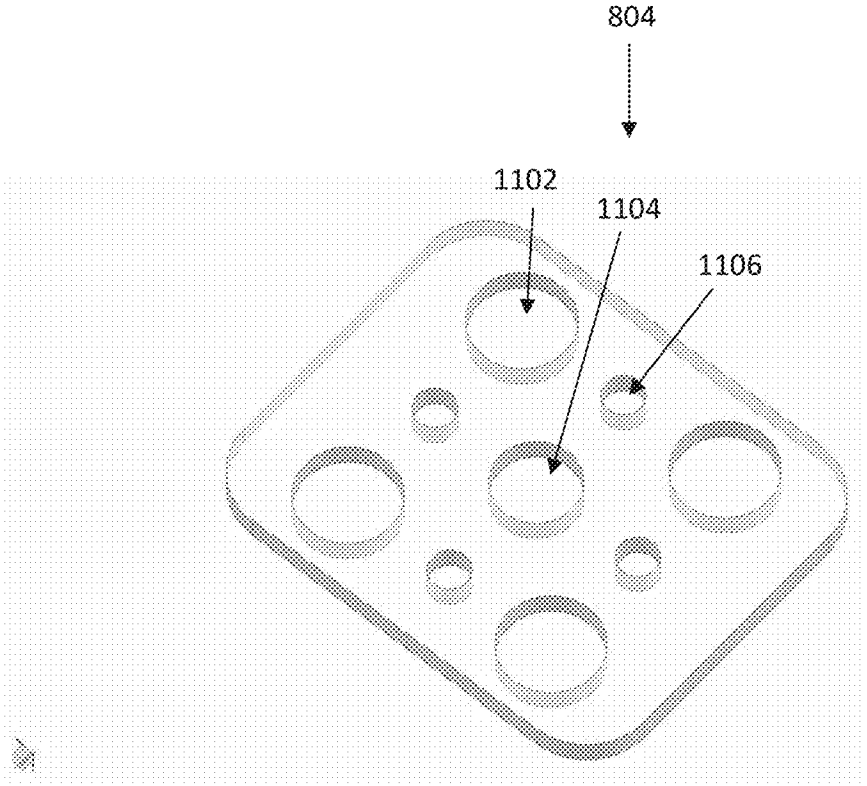
FIG. 11 is a top view of an actuator plate that may be used with the beverage dispensing system shown in FIG. 7.

Referring to FIG. 11, a top view of actuator plate 804 is illustrated. In an exemplary embodiment, each connector 704 and spring member 808 is coupled to holding plate 802. However, locking member 806 is not coupled to actuator plate 804.

In an exemplary embodiment, actuator plate 804 includes a plurality of connector openings 1102, a locking member opening 1104, and a plurality of spring member openings 1106. In a similar manner as described above with reference to holding plate 802, connectors 704 extend through a respective connector opening 1102, locking member 806 extends through locking member opening 1104, and spring members 808 extend through a respective spring member opening 1106.

Actuator plate 804 is designed to prepare connectors 704 for connecting to fitment 210 and for disconnecting from fitment 210. In an exemplary embodiment, movable sleeve 810 of each connector 704 is coupled to actuator plate 804 such that each sleeve 810 is automatically moved when actuator plate 804 is moved. For example, when actuator plate 804 is moved toward holding plate 802, movable sleeves 810 are also moved toward holding plate 802 to enable connectors 704 to be connected to fitment 210 or disconnected from fitment 210. When actuator plate 804 is moved away from holding plate 802, movable sleeves 810 are also moved away from holding plate 802 to enable movable sleeves 810 to latch onto fitments 210.

Figure 12:
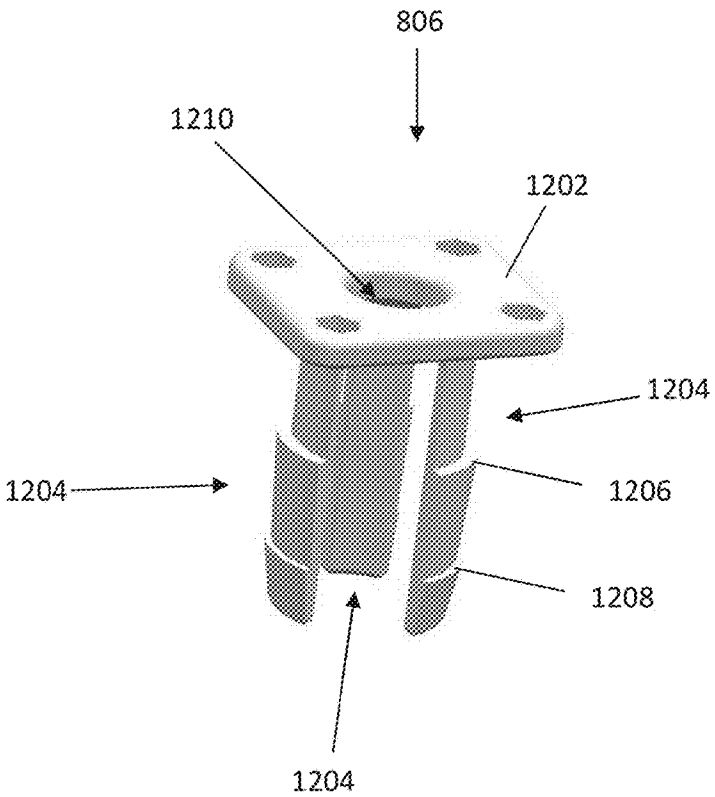
FIG. 12 is a side view of a locking member that may be used with the beverage dispensing system shown in FIG. 7.

Referring to FIG. 12, a side view of locking member 806 is illustrated. In an exemplary embodiment, locking member 806 includes a head portion 1202 and a plurality of legs 1204. Each leg 1204 includes a first engagement ridge 1206 and a second engagement ridge 1208.

Head portion 1202 includes a plurality of screw or bolt holes that enable locking member 806 to be screwed or bolted to holding plate 802. Alternatively, any other suitable means can be used to secure locking member 806 to holding plate 802. While head portion 1202 is securely attached to holding plate 802, legs 1204 extend through locking member opening 1004 of holding plate 802 and locking member opening 1104 of actuator plate 804 and are not attached to actuator plate 804.

In one embodiment, head portion 1202 includes a central opening 1210 extending through a center of head portion 1202. Alternatively, opening 1210 may be positioned in any suitable location of head portion 1202. Central opening 1210 enables a user to look through head portion 1202 (via opening 1210) to visibly identify locking member opening 220 of alignment plate 214. Accordingly, the user may align connector assembly 702 with alignment plate 214 when the user attaches connector assembly 702 to alignment plate 214. Central opening 1210 may also enable the user to visibly determine the level of liquid within one or more bags 206 when connector assembly 702 is attached to alignment plate 214 and box 200.

Locking member 806 enables connector assembly 702 to be securely attached, or locked, to alignment plate 214 of box 200. In addition, locking member 806 enables actuator plate 804 to be releasably secured in a position (also referred to as a "primed position") with respect to holding plate 802 that enables connector assembly 702 to be attached to alignment plate 214 as described more fully herein.

Figure 13:
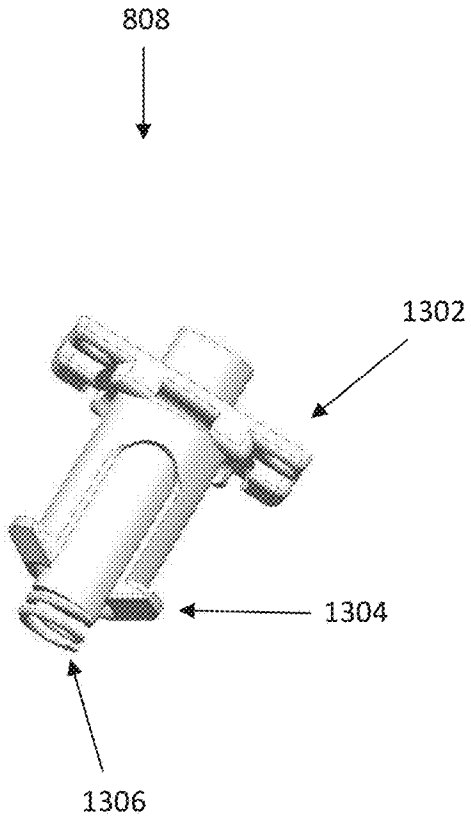
FIG. 13 is a top view of a spring member that may be used with the beverage dispensing system shown in FIG. 7.

Referring to FIG. 13, a top view of spring member 808 is illustrated. In an exemplary embodiment, each spring member 808 includes an upper flange 1302 and a lower flange 1304. Upper flange 1302 includes a plurality of screw or bolt holes that enable spring member 808 to be screwed or bolted to holding plate 802. Alternatively, any other suitable means can be used to secure upper flange 1302 to holding plate 802.

In an exemplary embodiment, spring members 808 are used to prevent actuator plate 804 from moving more than a predefined distance away from holding plate 802. For example, lower flange 1304 engages a bottom surface of actuator plate 804 (the surface facing away from holding plate 802) to prevent actuator plate 804 from moving past lower flange 1304.

Spring member 808 includes a spring 1306 or other biasing component that extends out from a bottom portion of spring member 808 away from holding plate 802 and actuator plate 804. As described more fully herein, spring 1306 contacts alignment plate 214 of box 200 when connector assembly 702 is attached to alignment plate 214 and fitments 210. Spring 1306 therefore biases connector assembly 702 away from alignment plate 214 when connector assembly 702 is attached to alignment plate 214 to facilitate disengaging connector assembly 702 from alignment plate 214 and box 200.

Figure 14:
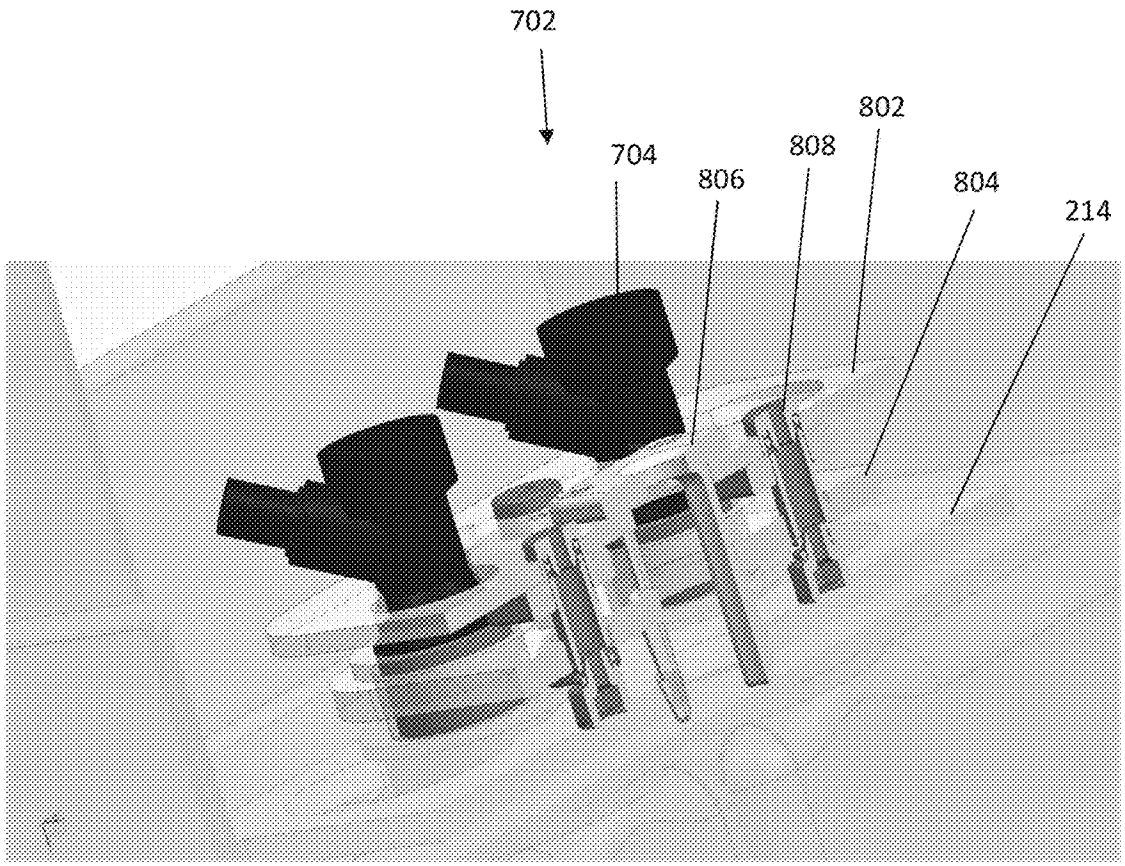
FIG. 14 is a perspective cut-away view of the connector assembly shown in FIG. 8 taken along line A-A.
Figure 15:
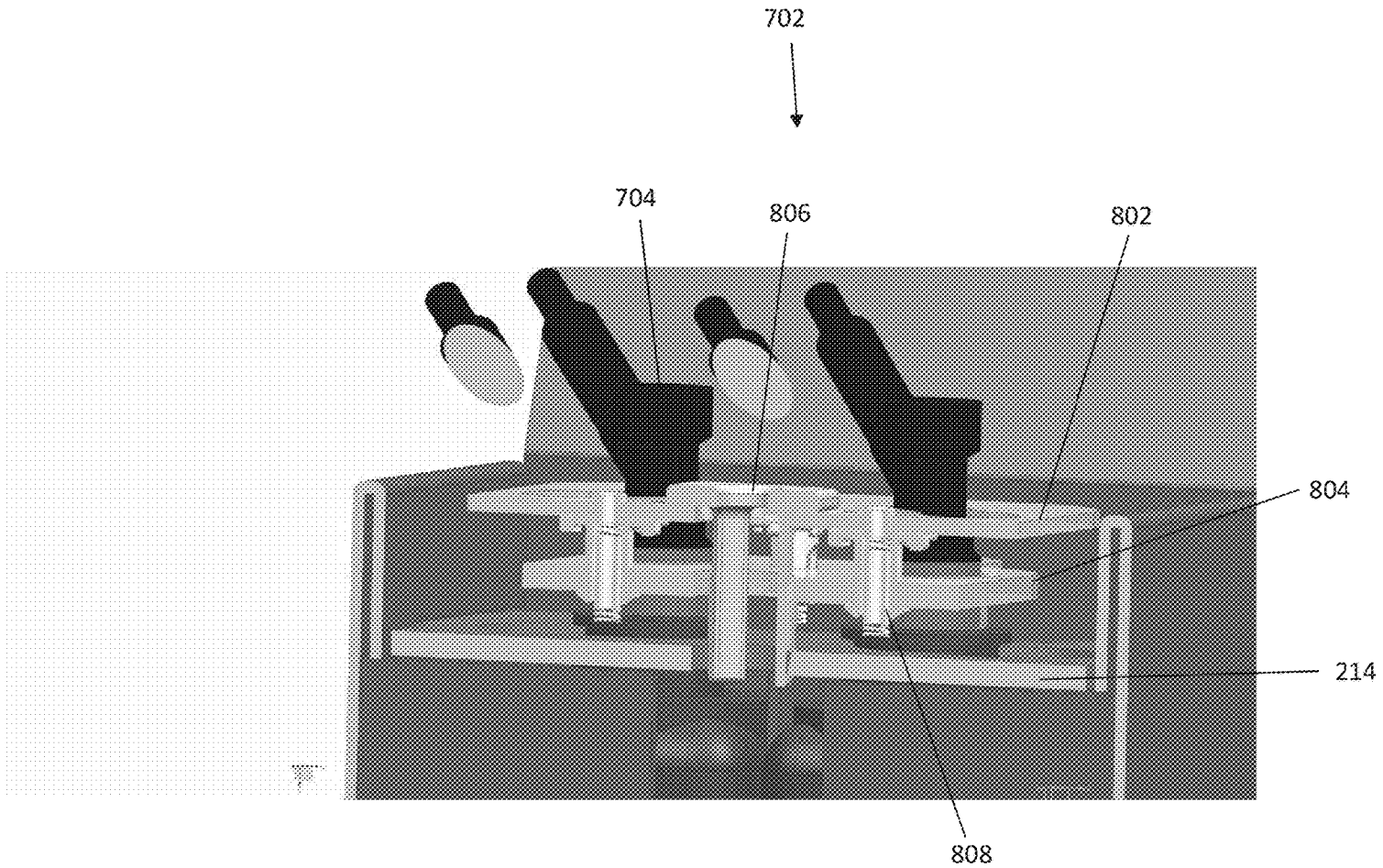
FIG. 15 is a side cut-away view of the connector assembly shown in FIG. 8 taken along line A-A.

Referring to FIG. 14, a perspective cut-away view of connector assembly 702 taken along line A-A is illustrated. FIG. 15 is a side cut-away view of connector assembly 702 taken along line A-A. FIGS. 14 and 15 may be used to illustrate the operation of connector assembly 702 when connecting to alignment plate 214 or when disconnecting from alignment plate 214.

As described above, box 200 is typically shipped or transported disconnected from connector assembly 702, and a cap 212 covers each fitment 210 of each bag 206. Once the box 200 and connector assembly 702 arrive at a destination for assembly, a user removes caps 212 from fitments 210.

The user then holds connector assembly 702 and pulls actuator plate 804 towards holding plate 802 to prepare connector assembly 702 for connection to box 200. As actuator plate 804 moves toward holding plate 802, legs 1204 of locking member 806 move further through locking member opening 1104 of actuator plate 804 until actuator plate 804 reaches first engagement ridge 1206. First engagement ridge 1206 of each leg 1204 snaps into position contacting the bottom surface of actuator plate 804. In addition, since movable sleeve 810 of each connector 704 is attached to actuator plate 804, each movable sleeve 810 is pushed toward holding plate 802, thus preparing each connector 704 for attachment to a respective fitment 210.

The user may then release actuator plate 804. First engagement ridge 1206 of each locking member leg 1204 securely holds actuator plate 804 (and connector assembly 702) in a primed position (i.e., a position ready for attachment to box 200).

Next, the user presses connector assembly 702 onto alignment plate 214 such that connectors 704 attach to fitments 210. The user may do so by wrapping his or her fingers around grip portion 302 of alignment plate 214, placing his or her palm on holding plate 802, and contracting the fingers toward the palm. As this happens, legs 1204 of locking member 806 move through locking member opening 220 of alignment plate 214.

In an exemplary embodiment, locking member opening 220 in alignment plate 214 has a smaller diameter than a diameter of locking member opening 1104 of actuator plate 804. Accordingly, when legs 1204 of locking member 806 begin to enter locking member opening 1104 of alignment plate 214, legs 1204 are pressed or bent inward by the relatively small diameter of locking member opening 220 of alignment plate 214 as compared to the diameter of the locking member opening 1104 of actuator plate 804. As legs 1204 are pushed inward from the insertion force of pressing connector assembly 702 onto alignment plate 214, first engagement ridge 1206 of each leg 1204 also is pressed inward and disengages from actuator plate 804. Thus, holding plate 802 is freed to move away from actuator plate 804 by the biasing force of spring members 808 and/or movable sleeves 810.

As holding plate 802 moves away from actuator plate 804, movable sleeves 810 also are moved away from holding plate 802 and, as a result, latch onto fitments 210. Second engagement ridge 1208 of locking member 806 latches to the underside of alignment plate 214 (i.e., the surface of alignment plate 214 facing away from connector assembly 702) to secure connector assembly 702 to alignment plate 214.

At this point, connector assembly 702 is securely attached to alignment plate 214 and fitments 210 by second engagement ridge 1208 of locking member 806 and by the biasing force of spring members 808. Furthermore, an uninterrupted fluid communication path is formed by the fact that bags 206, outlets 404, fitments 210, connectors 704, intermediate dispensing line 706 (if provided), and main dispensing line 708 are all positioned in flow communication with each other. The alcoholic beverage (or other contents) within each bag 206 may then be dispensed using a nozzle or other tool coupled to main dispensing line 708.

If the user wants to disconnect box 200 from connector assembly 702, the user grasps actuator plate 804 and holding plate 802, and squeezes the plates together to move actuator plate 804 toward holding plate 802. The diameter of locking member opening 1104 of actuator plate 804 is smaller than the portion of each leg 1204 between first engagement ridge 1206 and second engagement ridge 1208. Thus, when actuator plate 804 is moved toward holding plate 802, legs 1204 are forced inward again. As legs 1204 are forced inward, second engagement ridge 1208 disengages from alignment plate 214 such that alignment plate 214 is no longer held in place by locking member 806. The biasing force of spring members 808 against alignment plate 214 causes connector assembly 702 to be pushed away from alignment plate 214, and connectors 704 are automatically disengaged from fitments 210 and outlets 404.

When actuator plate 804 is moved sufficiently close to holding plate 802, first engagement ridge 1206 of each leg 1204 snaps into position contacting the bottom surface of actuator plate 804. The user may then release actuator plate 804. At this point, actuator plate 804 is now back in the primed position and connector assembly 702 is ready to be attached to another box 200, if desired.

Figure 16:
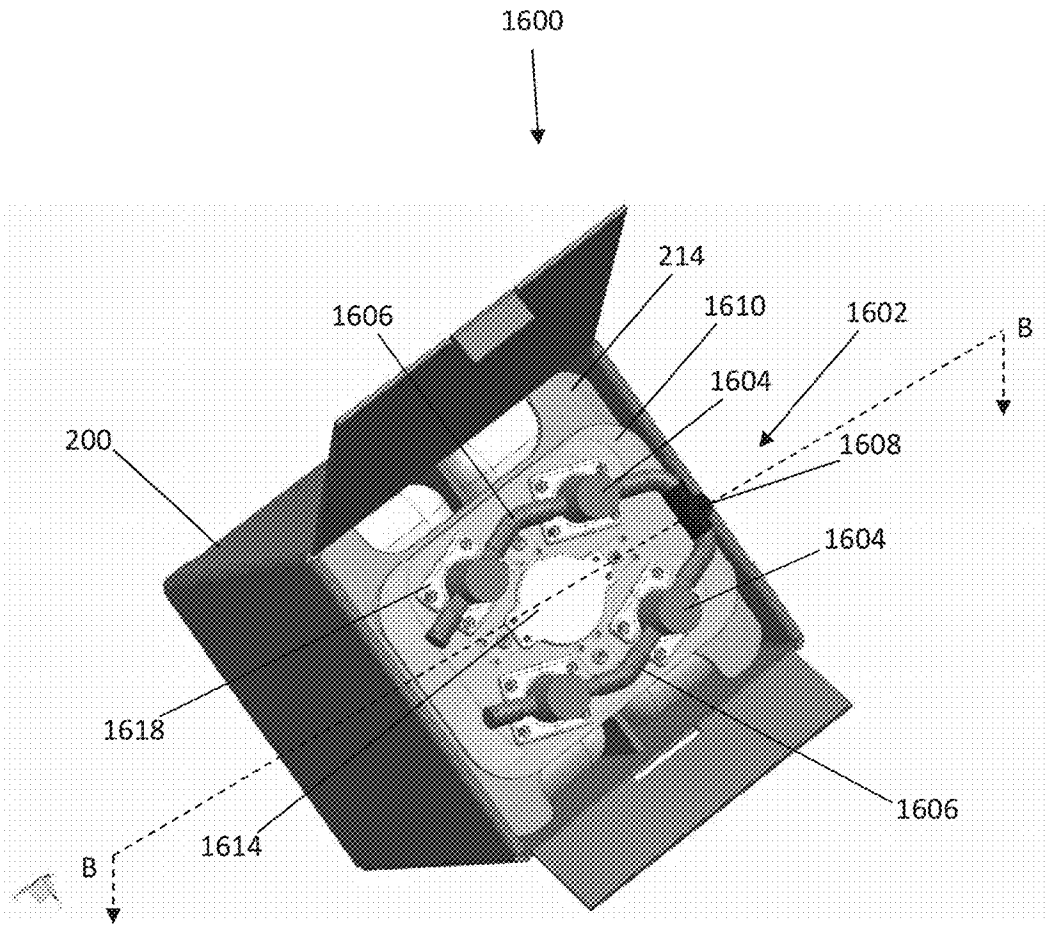
FIG. 16 is a perspective view of another beverage dispensing system.

Referring to FIG. 16, a perspective view of a second embodiment of a beverage dispensing system 1600 is illustrated. Beverage dispensing system 1600 includes a beverage dispensing package 200 (e.g., a box) and a connector assembly 1602 that is removably coupled to box 200.

In an exemplary embodiment, box 200 includes four bags positioned within four compartments created by two dividers. Alternatively, any suitable number of compartments, bags, and dividers may be used with box 200. As described above, box 200 includes an alignment plate 214 and fitments 210.

Figure 17B:
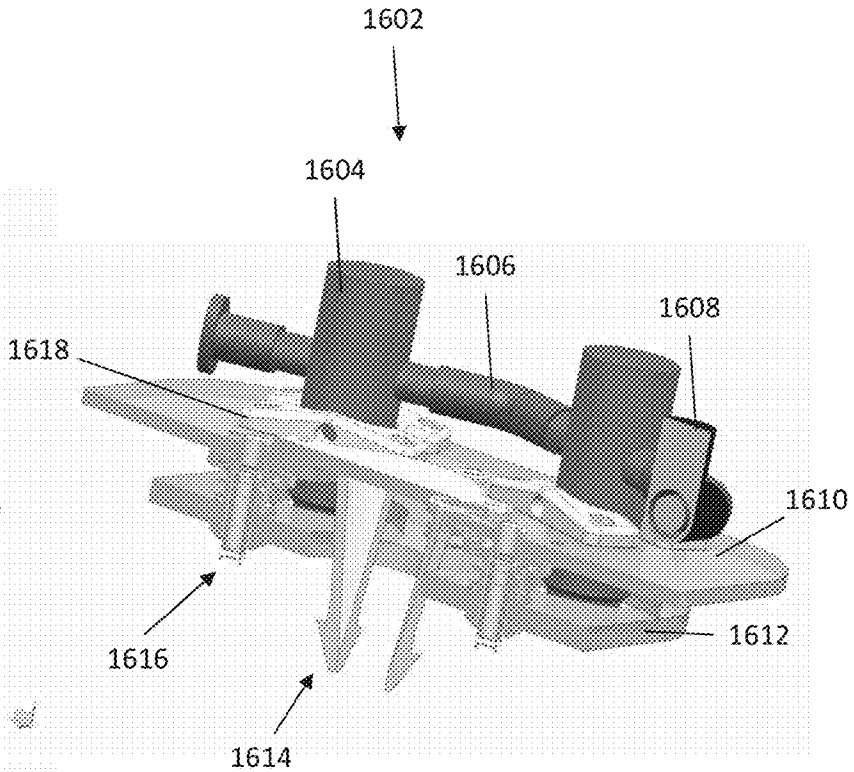
FIG. 17B is a perspective cut-away view of the connector assembly of FIG. 16 taken along line B-B.
Figure 17A:
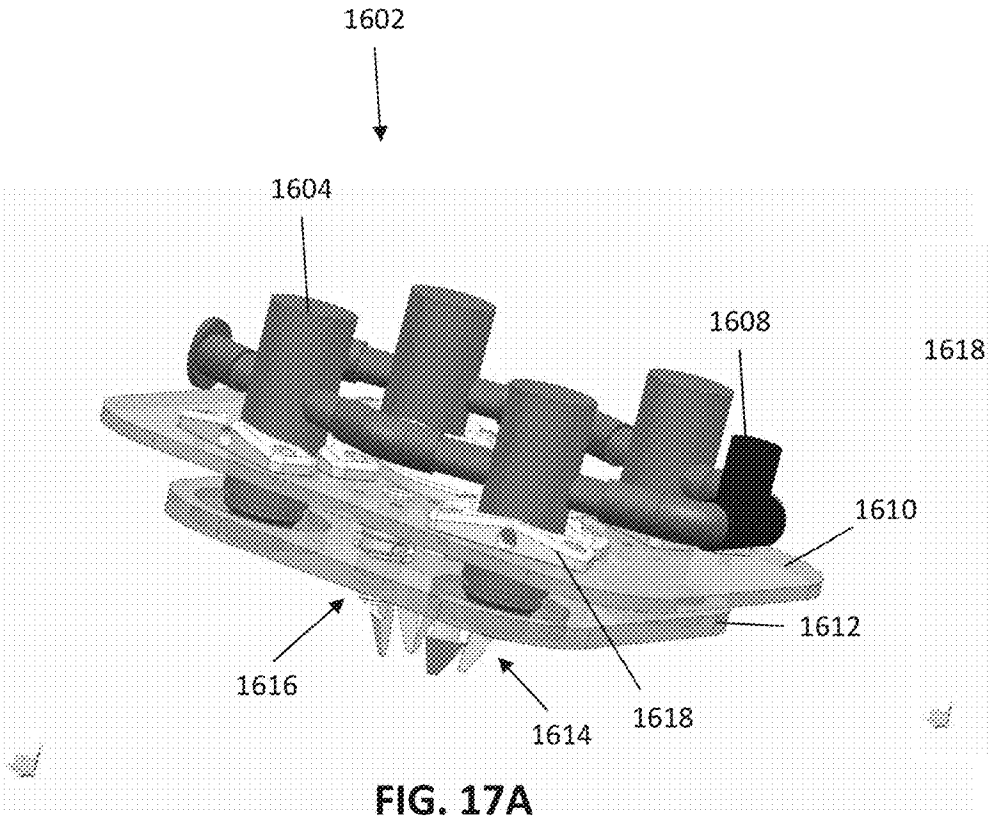
FIG. 17A is a perspective view of a connector assembly that may be used with the beverage dispensing system shown in FIG. 16.

FIG. 17A is a perspective view of connector assembly 1602 and FIG. 17B is a perspective cut-away view of connector assembly 1602 taken along line B-B.

As illustrated in FIGS. 16, 17A, and 17B, connector assembly 1602 includes a plurality of connectors 1604 that are coupled together by a single main dispensing line 1606 which terminates in a main dispensing outlet 1608. Connector assembly 1602 also includes a holding plate 1610, an actuator plate 1612, a locking member 1614, and a plurality of spring members 1616. A mounting bracket 1618 couples each connector 1604 to holding plate 1610 in an exemplary embodiment.

In the embodiment shown in FIGS. 16, 17A, and 17B, connectors 1604 are so-called "push connectors". More specifically, in one embodiment, connectors 1604 are QCD II connectors. Accordingly, connectors 1604 may be pushed into engagement with fitments 210 without first needing to be placed in a primed position (as compared to connectors 704 of FIG. 7, for example).

Figure 18:
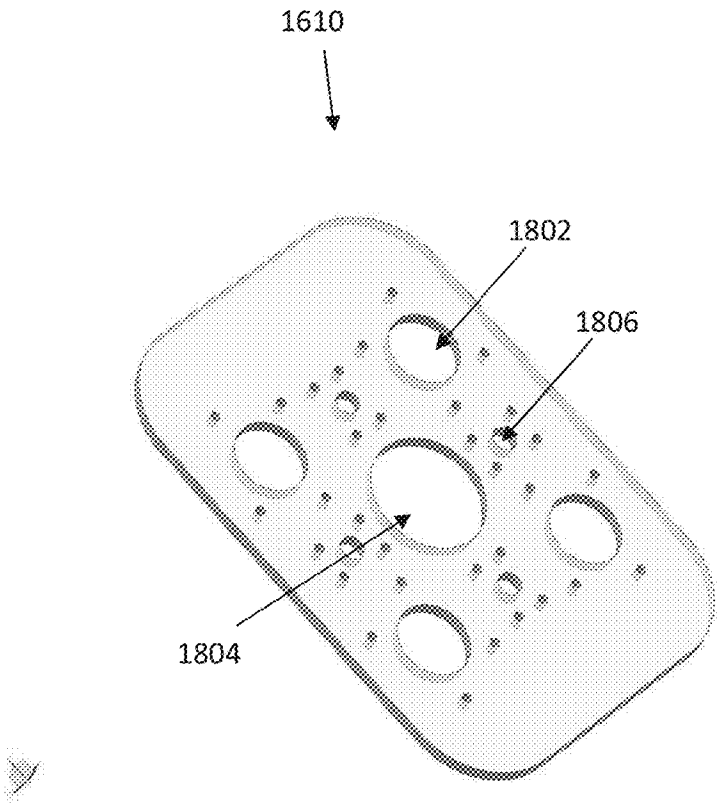
FIG. 18 is a perspective view of a holding plate that may be used with the beverage dispensing system shown in FIG. 16.

Referring to FIG. 18, a perspective view of holding plate 1610 is illustrated. Holding plate 1610 includes a plurality of connector openings 1802, a locking member opening 1804, and a plurality of spring member openings 1806. Holding plate 1610 is substantially similar to holding plate 802 (shown in FIG. 10) with the exception that connector openings 1802 are substantially circular, rather than keyhole shaped. Otherwise, holding plate 1610 operates substantially similarly to holding plate 1610 unless otherwise specified.

Figure 19:
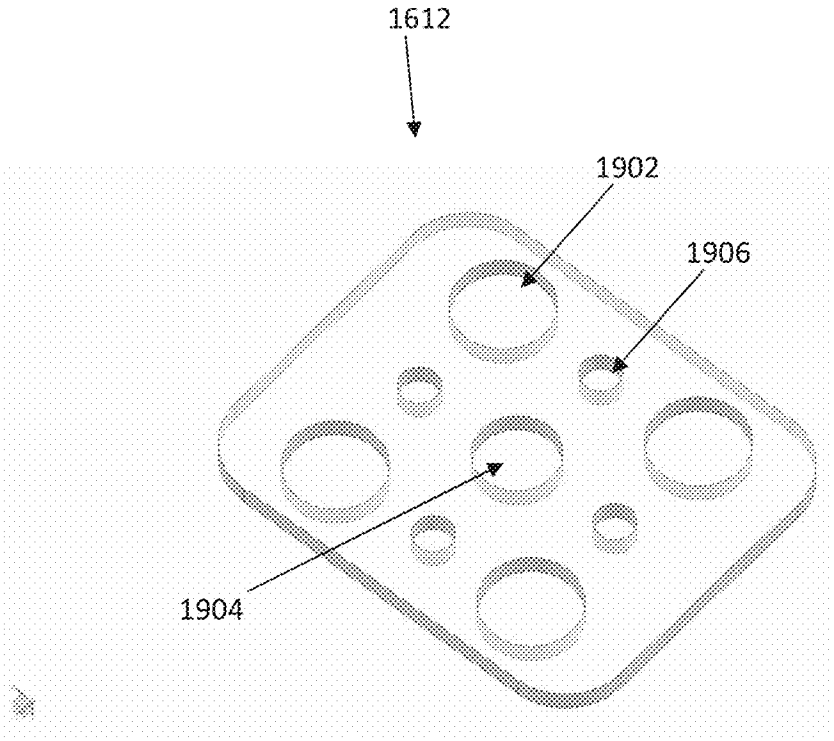
FIG. 19 is a perspective view of an actuator plate that may be used with the beverage dispensing system shown in FIG. 16.

Referring to FIG. 19, a perspective view of actuator plate 1612 is illustrated. Actuator plate 1612 includes a plurality of connector openings 1902, a locking member opening 1904, and a plurality of spring member openings 1906. Connector openings 1902 are sized and shaped to enable connectors 1604 to extend through actuator plate 1612 without engaging with actuator plate 1612. Accordingly, in this embodiment, connectors 1604 are not coupled to or otherwise engaged with actuator plate 1612 in contrast to connectors 704 (shown in FIG. 7) where movable sleeves 810 (shown in FIG. 8) are engaged with actuator plate 1612. Otherwise, actuator plate 1612 is substantially similar to actuator plate 804 (shown in FIG. 11) and operates substantially similarly unless otherwise noted.

Figure 20:
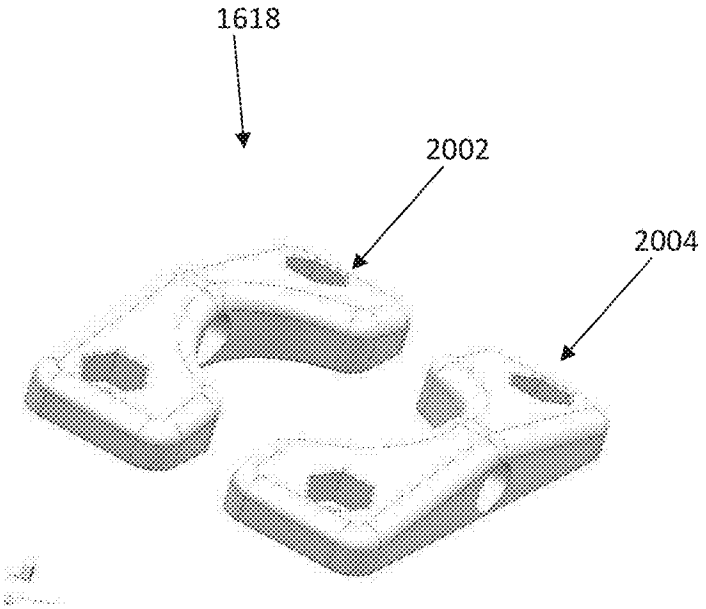
FIG. 20 is a perspective view of a mounting bracket that may be used with the beverage dispensing system shown in FIG. 16.

Referring to FIG. 20, a perspective view of mounting bracket 1618 is illustrated. In one embodiment, each mounting bracket 1618 includes a first portion 2002 and a second portion 2004 that cooperate together to secure each connector 1604 to holding plate 1610. For example, when assembling connector assembly 1602, connectors 1604 may be first positioned within respective connector openings 1802 of holding plate 1610. First portion 2002 and second portion 2004 of mounting bracket 1618 may then be placed on either side of each connector 1604 and may be bolted, screwed, or otherwise attached to holding plate 1610 to securely hold each connector 1604 in place with respect to holding plate 1610.

Figure 21:
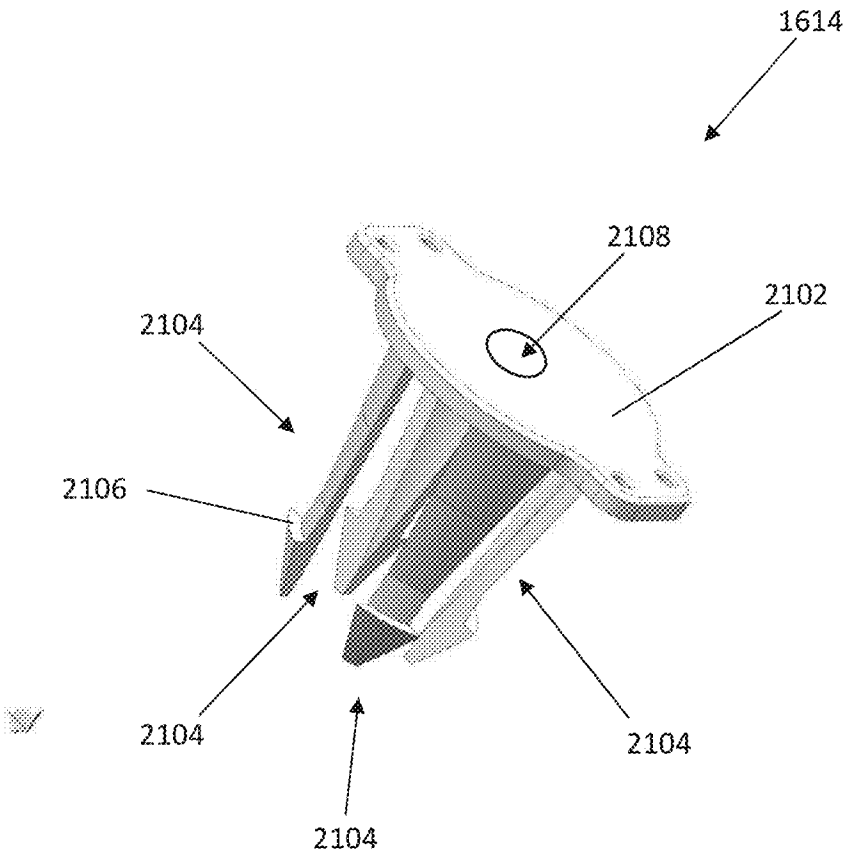
FIG. 21 is a perspective view of a locking member that may be used with the beverage dispensing system shown in FIG. 16.

Referring to FIG. 21, a perspective view of locking member 1614 is shown. Locking member 1614 includes a head portion 2102 and a plurality of legs 2104 that each include a first engagement ridge 2106. Accordingly, locking member 1614 is substantially similar to locking member 806 (shown in FIG. 12) except that locking member 1614 includes only a first engagement ridge 2106 (which is similar to second engagement ridge 1208 of locking member 806).

Similar to locking member 806, head portion 2102 of locking member 1614 includes a central opening 2108 extending through a center of head portion 2102. Alternatively, opening 2108 may be positioned in any suitable location of head portion 2102. Central opening 2108 enables a user to look through head portion 2102 (via opening 2108) to visibly identify locking member opening 220 of alignment plate 214. Accordingly, the user may align connector assembly 1602 with alignment plate 214 when the user attaches connector assembly 1602 to alignment plate 214. Central opening 2108 may also enable the user to visibly determine the level of liquid within one or more bags 206 when connector assembly 1602 is attached to alignment plate 214 and box 200.

Figure 22:
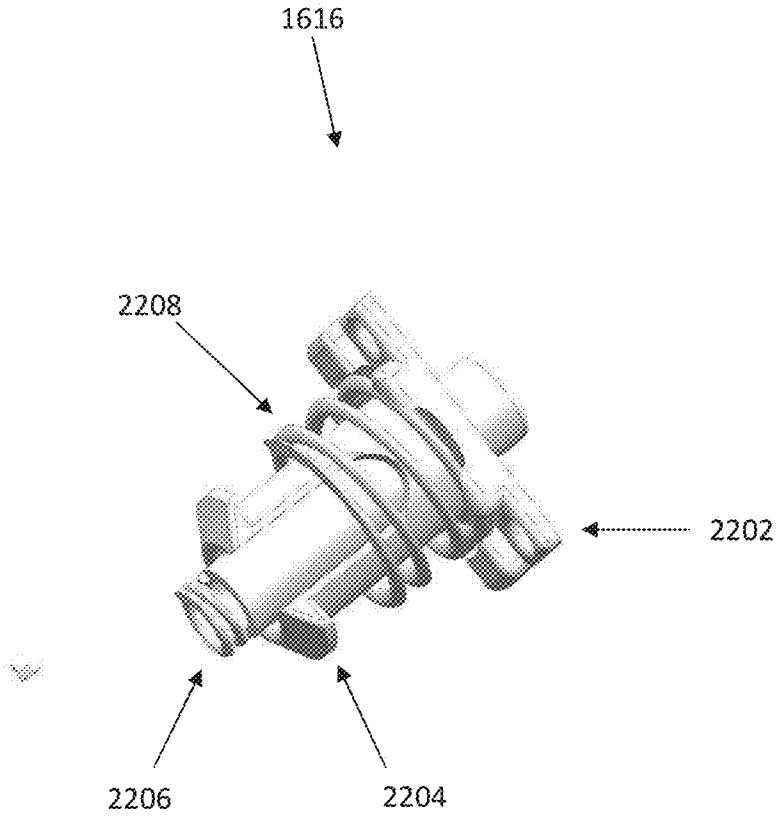
FIG. 22 is a perspective view of a spring member that may be used with the beverage dispensing system shown in FIG. 16.

Referring to FIG. 22, a perspective view of spring member 1616 is shown. In an exemplary embodiment, each spring member 1616 includes an upper flange 2202 and a lower flange 2204 that are substantially similar to upper flange 1302 and lower flange 1304 shown in FIG. 13. Spring members 1616 also include a first spring 2206 that is similar to spring 1306 shown in FIG. 13.

In an exemplary embodiment, spring members 1616 also include a second spring 2208 that is positioned between holding plate 1610 and actuator plate 1612 when connector assembly 1602 is assembled. Second spring 2208 contacts an upper surface of actuator plate 1612 (i.e., the surface facing holding plate 1610) and biases actuator plate 1612 away from holding plate 1610.

Figure 23:
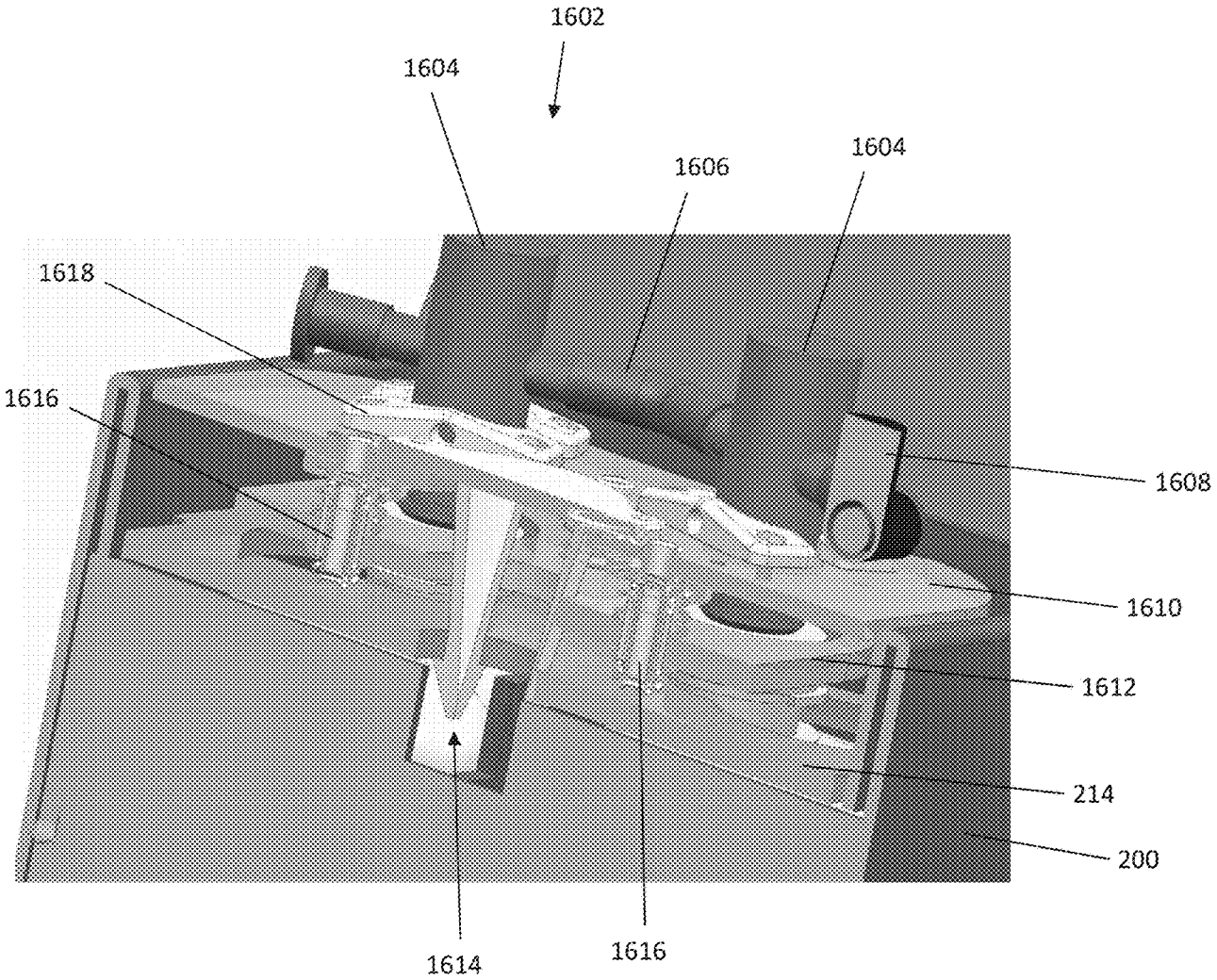
FIG. 23 is a perspective cut-away view of the connector assembly and box shown in FIG. 16 taken along line B-B.

Referring to FIG. 23, a perspective cut-away view of connector assembly 1602 and box 200 taken along line B-B is illustrated. FIG. 23 may be used to illustrate the operation of connector assembly 1602 when connecting to alignment plate 214 or when disconnecting from alignment plate 214.

As described above, box 200 is typically shipped or transported disconnected from connector assembly 1602 and a cap 212 covers each fitment 210 of each bag 206. Once the box 200 and connector assembly 1602 arrive at a destination for assembly, a user removes caps 212 from fitments 210.

In this embodiment, the user does not need to first pull actuator plate 1612 towards holding plate 1610 to prepare connector assembly 1602 for connection to box 200. Rather, the user just needs to align connectors 1604 with fitments 210, grasp holding plate 1610 and grip portions 302 of alignment plate 214, and then contract the user's hands together to push connector assembly 1602 into engagement with alignment plate 214.

As this happens, legs 2104 of locking member 1614 move through locking member opening 220 of alignment plate 214. First engagement ridge 2106 of locking member 1614 moves through locking member opening 220 of alignment plate 214 and latches to the underside of alignment plate 214 (i.e., the surface of alignment plate 214 facing away from connector assembly 1602).

At this point, connector assembly 1602 is securely attached to alignment plate 214 and fitments 210 by first engagement ridge 2106 of locking member 1614 and by the biasing force of spring members 1616. Furthermore, an uninterrupted fluid communication path is formed by the fact that bags 206, outlets 404, fitments 210, connectors 1604, intermediate dispensing line 706 (if provided), and main dispensing line 1606 are all positioned in flow communication with each other. The alcoholic beverage (or other contents) within each bag 206 may then be dispensed using a nozzle or other tool coupled to main dispensing line 1606.

If the user wants to disconnect box 200 from connector assembly 1602, the user grasps actuator plate 1612 and holding plate 1610, and squeezes the plates together to move actuator plate 1612 toward holding plate 1610. The diameter of locking member opening 1904 of actuator plate 1612 is smaller than the portion of each leg 2104 between first engagement ridge 2106 and head portion 2102. Thus, when actuator plate 1612 is moved toward holding plate 1610, legs 2104 are forced inward. As legs 2104 are forced inward, first engagement ridge 2106 disengages from alignment plate 214 such that alignment plate 214 is no longer held in place by locking member 1614. The biasing force of spring members 1616 against alignment plate 214 causes connector assembly 1602 to be pushed away from alignment plate 214, and connectors 1604 are automatically disengaged from outlets 404 and fitments 210.

Referring to FIG. 24, a perspective view of a third embodiment of a beverage dispensing system 2400 is illustrated. Beverage dispensing system 2400 includes a beverage dispensing package 200 (e.g., a box) and a connector assembly 2402 that is removably coupled to box 200.

In an exemplary embodiment, box 200 includes four bags positioned within four compartments created by two dividers. Alternatively, any suitable number of compartments, bags, and dividers may be used with box 200. As described above, box 200 includes an alignment plate 214 and fitments 210.

As illustrated in FIG. 24, connector assembly 2402 includes a handle assembly 2404 that covers a plurality of connectors (not shown). In one embodiment, connector assembly 2402 is substantially similar to connector assembly 702 (shown in FIG. 7) and is usable with the push-pull connectors described therein. Alternatively, connector assembly 2402 may be substantially similar to connector assembly 1602 (shown in FIG. 16) and may be used with the push connectors described therein.

Handle assembly 2404 includes a handle 2406 that enables a user to easily and securely grasp connector assembly 2402 to facilitate engaging or disengaging connector assembly 2402 and alignment plate 214. Handle assembly 2404 also includes a release lever 2408 that enables the user to release the locking member from alignment plate 214. In one embodiment, release lever 2408 causes the actuator plate to move towards the holding plate to release the locking member from alignment plate 214 when the user pulls release lever 2408 toward handle 2406. In other respects, connector assembly 2402 operates substantially similar to connector assembly 702 or connector assembly 1602.

Figure 25:
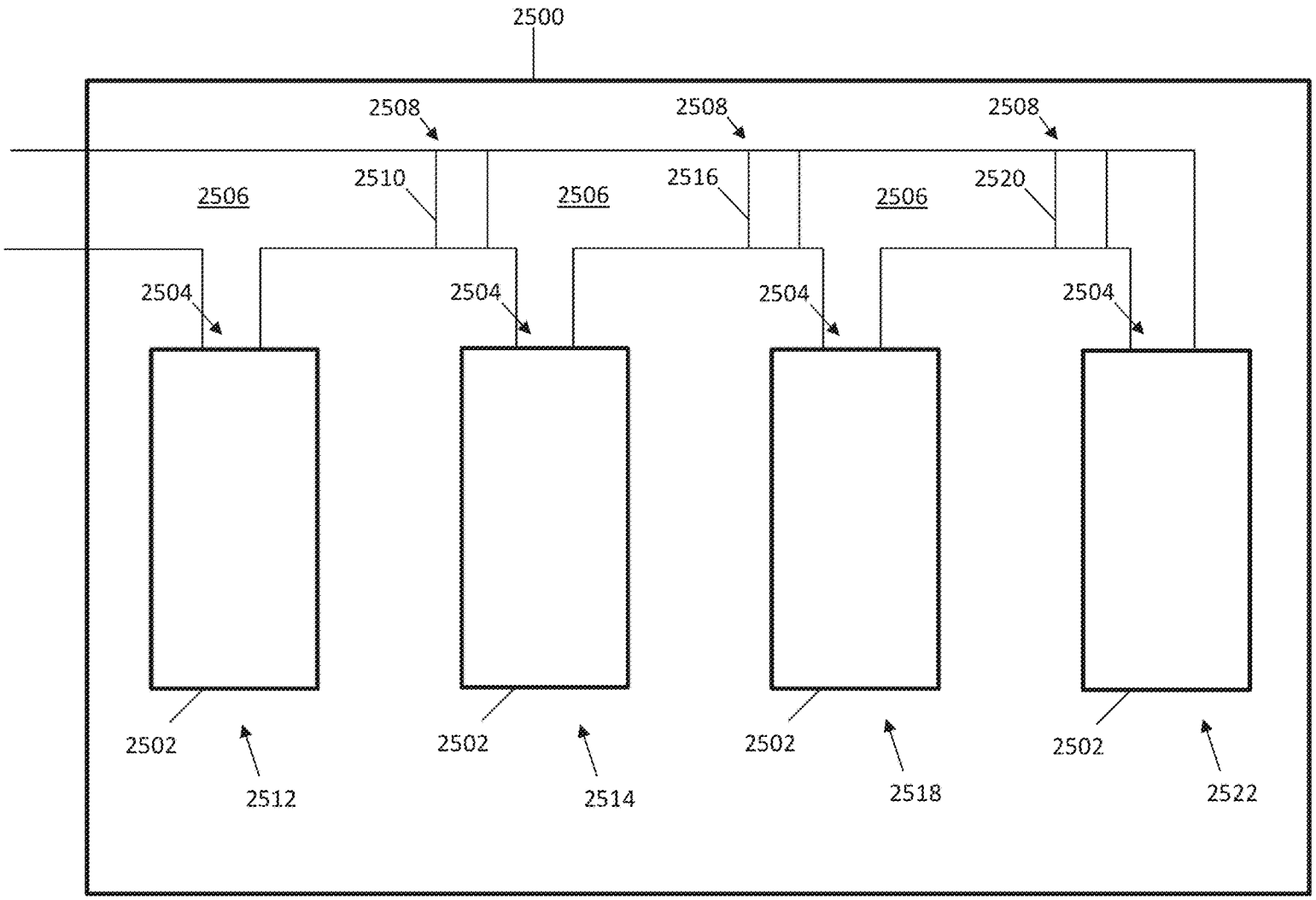
FIG. 25 is a block diagram of a beverage dispensing package having an alternative arrangement of containers.

FIG. 25 is a block diagram of a box 2500 having an alternative arrangement of bags 2502. In the example shown in FIG. 25, bags 2502 each include an outlet 2504 that is coupled to a common internal dispensing line 2506 within box 2500. Internal dispensing line 2506 extends to an exterior of box 2500 and is connectable to any suitable connector, connector assembly, or nozzle to dispense the contents of each bag 2502 through line 2506.

A plurality of membranes or pressure relief valves 2508 are positioned within internal dispensing line 2506. In an exemplary embodiment, each membrane 2508 is positioned between outlets 2504 of two adjacent bags 206 (i.e., an upstream bag and a downstream bag) to prevent the contents of the upstream bag from being dispensed until the downstream bag is fully dispensed. Accordingly, a first membrane 2510 is positioned within internal dispensing line 2506 between an outlet 2504 of a first bag 2512 and an outlet 2504 of a second bag 2514. A second membrane 2516 is positioned within internal dispensing line 2506 between outlet 2504 of second bag 2514 and an outlet 2504 of a third bag 2518. A third membrane 2520 is positioned within internal dispensing line 2506 between outlet 2504 of third bag 2518 and an outlet 2504 of a fourth bag 2522.

Each membrane 2508 is configured to break, open, or otherwise be released when a successively greater pressure is exerted as compared to a downstream membrane 2508. Accordingly, first membrane 2510 is configured to open when a first pressure is exerted on internal dispensing line 2506 (and thus on first membrane 2510), second membrane 2516 is configured to open when a second pressure is exerted on internal dispensing line 2506, and third membrane 2520 is configured to open when a third pressure is exerted on internal dispensing line 2506. In the exemplary embodiment, the first pressure is less than the second pressure, and the second pressure is less than the third pressure.

During operation, when a nozzle or other dispensing mechanism exerts pressure on internal dispensing line 2506, the contents of first bag 2512 are dispensed until first bag 2512 is empty. After first bag 2512 is empty, the pressure increases until it exceeds the first pressure, at which point first membrane 2510 opens. The contents of second bag 2514 now begin to be dispensed. When second bag 2514 is empty, the pressure increases until it exceeds the second pressure. Second membrane 2516 opens and the contents of third bag 2518 begin to be dispensed. When third bag 2518 is empty, the pressure increases until it exceeds the third pressure. Third membrane 2520 opens and the contents of fourth bag 2522 are dispensed. In such a manner, the contents of each bag may be dispensed successively.

Figure 26:
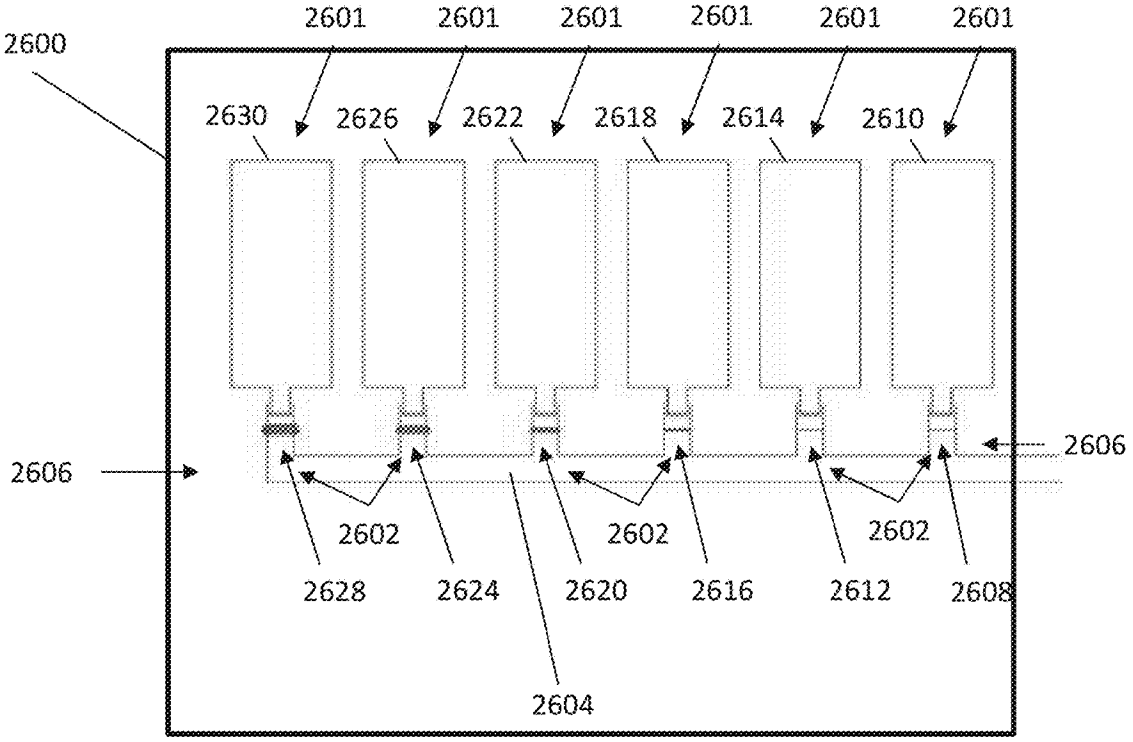
FIG. 26 is a block diagram of another beverage dispensing package having an alternative arrangement of containers.

FIG. 26 is a block diagram of a box 2600 having another alternative arrangement of bags 2601. In the example shown in FIG. 26, bags 2601 each include an outlet 2602 that is coupled to a common internal dispensing line 2604 within box 2600 in a similar manner as box 2500 (shown in FIG. 25). Internal dispensing line 2604 extends to an exterior of box 2600 and is connectable to any suitable connector, connector assembly, or nozzle to dispense the contents of each bag 2601 through line 2604.

A plurality of membranes or pressure relief valves 2606 are positioned within internal dispensing line 2604. In an exemplary embodiment, each membrane 2606 is positioned between an outlet 2602 of a respective bag 2601 and internal dispensing line 2604 to prevent the contents of bag 2601 from being dispensed until membrane 2606 is opened. Accordingly, a first membrane 2608 is positioned between outlet 2602 of a first bag 2610 and internal dispensing line 2604, and a second membrane 2612 is positioned between outlet 2602 of a second bag 2614 and internal dispensing line 2604. A third membrane 2616 is positioned between outlet 2602 of a third bag 2618 and internal dispensing line 2604, and a fourth membrane 2620 is positioned between outlet 2602 of a fourth bag 2622 and internal dispensing line 2604. In addition, in the example shown in FIG. 26, a fifth membrane 2624 is positioned between outlet 2602 of a fifth bag 2626 and internal dispensing line 2604, and a sixth membrane 2628 is positioned between outlet 2602 of a sixth bag 2630 and internal dispensing line 2604.

Each membrane 2606 is configured to break, open, or otherwise be released when a successively greater pressure is exerted as compared to a downstream membrane 2606. Accordingly, in the example shown in FIG. 26, each membrane 2606 has a different thickness or strength as compared to each other membrane. For example, first membrane 2608 has a first thickness, second membrane 2612 has a second thickness that is larger than the first thickness, third membrane 2616 has a third thickness that is larger than the second thickness, and fourth membrane 2620 has a fourth thickness that is larger than the third thickness. In addition, fifth membrane 2624 has a fifth thickness that is larger than the fourth thickness, and sixth membrane 2628 has a sixth thickness that is larger than the fifth thickness. Accordingly, a successively higher pressure is required to open each successive upstream membrane to empty the contents of the associated bag 2601 in a similar manner as described above with reference to FIG. 25.

In an alternative embodiment, the different pressures needed to open each membrane 2606 may be accomplished by using portions of internal dispensing line 2604 having a different diameter. For example, a membrane 2606 associated with each bag outlet 2602 may be positioned in a portion of internal dispensing line 2604 that has a different diameter (and thus a different pressure) than the portions of internal dispensing line 2604 associated with the other membranes 2606.

The arrangement of bags described in FIGS. 25 and 26 enables each bag to be connected to an internal dispensing line, but the contents of each bag are maintained in a separated state until the bags are dispensed. As a result, the box may be shipped with the outlets of the bags in a "divorced" state and the outlets may be efficiently and conveniently connected at a dispensing site.

Figure 27:
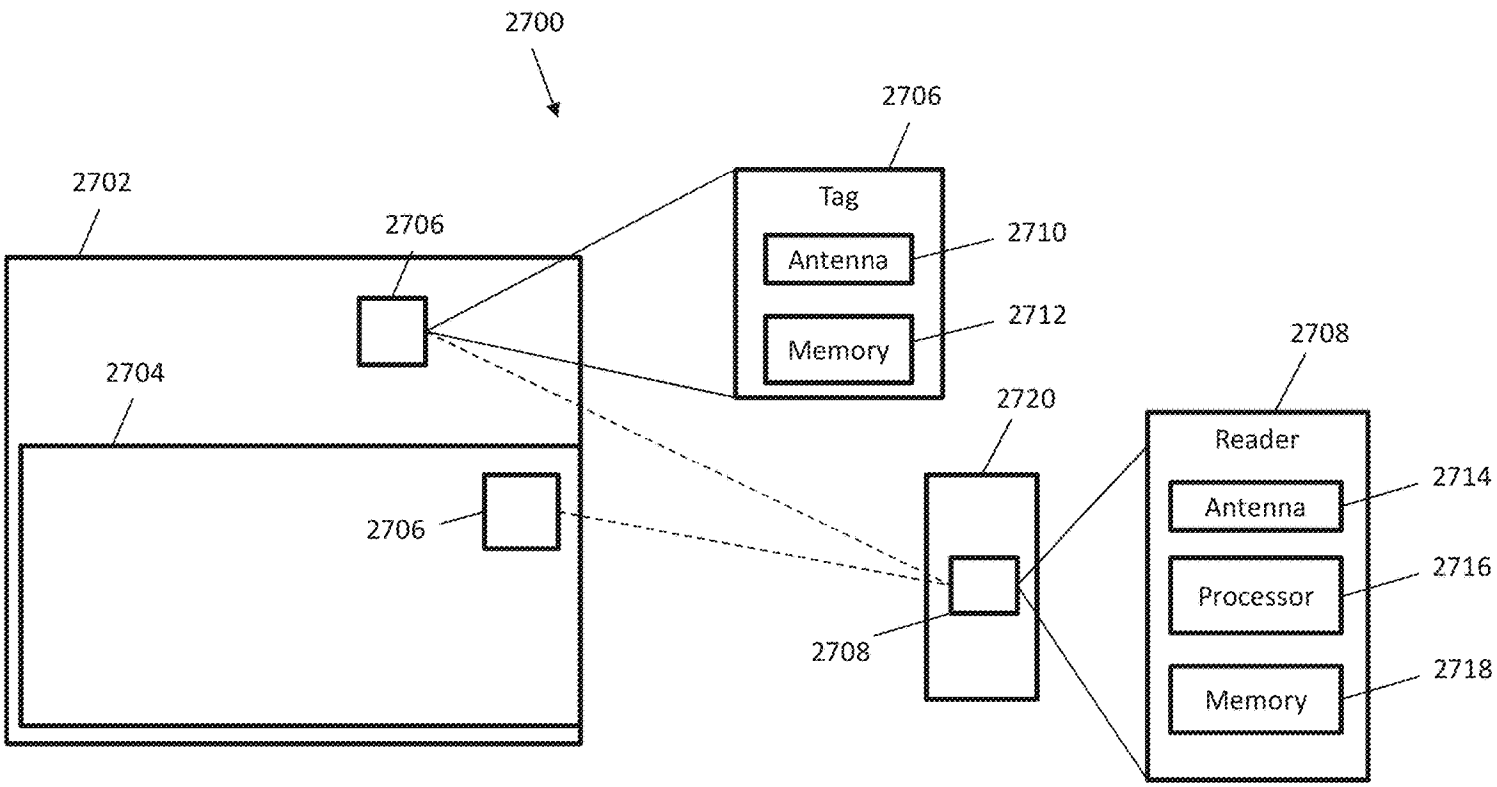
FIG. 27 is a block diagram of an exemplary system that may be used to monitor a beverage dispensing system.

FIG. 27 is a block diagram of an exemplary system 2700 that may be used to monitor a beverage dispensing system. System 2700 may be used with any of the beverage dispensing systems described herein.

In the example shown in FIG. 27, system 2700 includes a box 2702 that includes a plurality of bags 2704 similar to the boxes and bags described in the foregoing embodiments. A programmable tag 2706 is coupled to box 2702 and/or to bags 2704 in the exemplary embodiment. Tag 2706 may be used to determine the contents of box 2702 and/or bags 2704 as described more fully herein. In addition, a tag reader 2708 is provided that is able to read the contents of each tag 2706.

Tag 2706 may include an antenna 2710 and a memory 2712, such as a computer-readable memory. While tag 2706 is described herein as a radio frequency identification (RFID) tag 2706, it should be recognized that tag 2706 may be any suitable tag that is readable by an associated reader. For example, tag 2706 may be embodied as a quick response (QR) code, a bar code, a near field communication (NFC) tag, or any other suitable tag.

Antenna 2710 is configured to receive signals from tag reader 2708 and to provide data stored in memory 2712 in response to the signals received from tag reader 2708.

Memory 2712 stores data related to box 2702 or bag 2704 to which tag 2706 is attached. In an exemplary embodiment, memory 2712 is programmed to include profile data for box 2702 or bag 2704, such as the type of alcoholic beverage (or other liquid) stored in each bag 2704, the alcohol content, a brand name, an age, a production date, and/or a batch number of the alcoholic beverage stored in each bag 2704. Additionally or alternatively, the profile data may include a volume of bag 2704 and/or a volume of the alcoholic beverage stored in bag 2704, a unique identification number of the container (i.e., of bag 2704 or box 2702), a distributor of the alcoholic beverage, and/or any other suitable data. The profile data may be programmed or stored in memory 2712 during a filling process of bag 2704. Alternatively, the profile data may be included in pre-printed labels that may be attached to bags 2704 or boxes 2702 corresponding to the labels.

Still alternatively, a tag 2706 may be affixed to, or included within, bags 2704 and/or boxes 2702 before shipping or transport. Upon receipt of boxes 2702 and/or bags 2704 by the end user, tag reader 2708 scans each tag 2706 and assigns the profile of the contents corresponding to each bag 2704 or box 2702 to the unique identification number of the respective bag 2704 or box 2702.

While tag reader 2708 is described herein as an RFID reader, it should be recognized that tag reader 2708 may be any suitable reader that is designed and capable of reading tags 2706. In the exemplary embodiment, tag reader 2708 includes an antenna 2714, a processor 2716, and a memory 2718.

Antenna 2714 is configured to transmit signals to tags 2706 to request data from tags 2706. In addition, antenna 2714 is configured to receive the signals from tags 2706 in response to the data request.

Processor 2716 is configured to generate the signals to antenna 2714 and to receive the signals from antenna 2714. In addition, processor 2716 may be configured to read data from memory 2718 and to store data in memory 2718.

Memory 2718 is configured to store the data received from tags 2706 when tags 2706 are "read" (i.e., when signals requesting data from tags 2706 are transmitted to tags 2706 and when the data responsive to the requests are received).

In one embodiment, tag reader 2708 is integrated into a connector assembly 2720 to enable connector assembly 2720 to read the profile data from tags 2706 associated with bags 2704 attached to connector assembly 2720. For example, tag reader 2708 may be integrated into each connector, into the holding plate, into the actuator plate, and/or into any suitable portion of connector assembly 2720. Alternatively, tag reader 2708 may be integrated into a stand-alone device, such as a handheld computing device or any other suitable device.

When bags 2704 and boxes 2702 have tags 2706 included therein or affixed thereto, significant operational efficiencies can be gained. A tag reader mounted in close proximity to a container (e.g., a bag 2704 or box 2702) may read the unique identification number of the container.

In one embodiment, tag reader 2708 may store data representative of the profiles (or profile data) associated with bags 2704 that are intended to be used with the beverage dispensing system. If processor 2716 determines that the profile data of a bag 2704 connected to connector assembly 2720, for example, does not match the expected profile data for the beverage dispensing system, processor 2716 may notify a user that bag 2704 does not include the expected profile data.

In another embodiment, tag reader 2708, or another suitable device or system, may calculate the amount of liquids dispensed from each bag 2704 or box 2702. The amount of liquid dispensed can be compared to the amount of liquid expected to be inside bag 2704 or box 2702 based on the profile data of bag 2704 or box 2702. As a result, tag reader 2708 or another suitable device may determine when bag 2704 or box 2702 is empty, or has dispensed a predetermined amount or percentage of its contents. A user may then be notified which bag 2704 or box 2702 needs to be replaced.

When bag 2704 or box 2702 is replaced, tag reader 2708 may read the profile data of the replacement bag 2704 or box 2702 and determine that the unique identification number is different than the replaced bag 2704 or box 2702, for example. Accordingly, tag reader 2708 or another device or system may determine that a replacement bag or box has been provided, and may reset or begin to recalculate the amount of liquid dispensed by the new bag or box.

Tag reader 2708 or another device may also verify that the same type of alcoholic beverage is included in the replacement bag or box as compared to the replaced bag or box. If the type of beverage is different, the beverage dispensing system may be prevented from dispensing the contents of the replacement bag or box unless a user explicitly approves the dispensing, for example.

Tag reader 2708 or another device or component of the beverage dispensing system can store the profile data of each tag 2706 of each bag 2704 or box 2702 and may, for example, store the amount of liquid dispensed by each container. In case a previously used container is put back in the beverage dispensing system, tag reader 2708 is able to determine whether that container is empty or not. If the container is not empty, the system will continue to keep track of the amount of liquid dispensed by that specific container until the system determines that the container is empty. If the container is determined to be empty, tag reader 2708 or another device or component of beverage dispensing system may notify a user and the container will need to be replaced before normal operations can continue. In one embodiment, an acceptable empty tolerance level (or waste level) can be pre-set by the user of tag reader 2708 or the beverage dispensing system, thereby allowing containers to be exchanged before they are completely empty.

Tag reader 2708 or another device or component of the beverage dispensing system can alert the user about the status of the tagged containers through a light or audible signal, for example, or in any other suitable manner. The status that the user may be notified of may include, for example, that a container needs to be replaced, a container is close to being replaced (falls within the waste tolerance zone), or that a container is still able to dispense its contents. The status can also indicate that the contents of the container have not been assigned to a particular box 2702 or to a particular location within the beverage dispensing system, for example. This may help prevent cross-contamination of materials by the beverage dispensing system.

In the embodiments described herein, the connectors of each connector assembly are separate connectors that are connected together by one or more dispensing lines. In an alternative embodiment, the connectors of a connector assembly may be unitarily formed within a single common package. For example, a single connector package may include a plurality of holes, receptacles, or other connectors for receiving or connecting to the fitments of the bags. Alternatively, the fitments of the bags within a box may be connected to individual dispensing lines that are then connected to individual holes, receptacles, or other connectors within the unitarily formed connector package. The unitarily formed package may then dispense the alcoholic beverage received from the bags through a common or main outlet. Still alternatively, the unitarily formed connector package may be included within a nozzle such that the dispensing lines or the fitments of the bags may be connected directly to connectors formed within a single nozzle or the like.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A beverage dispensing system for dispensing liquids, the beverage dispensing system comprising:

a beverage dispensing package comprising:

an outer container;

at least one divider positioned within the outer container to form a plurality of compartments; and a plurality of inner containers, wherein one of the plurality of inner containers is positioned within each of the plurality of compartments, and wherein each inner container of the plurality of inner containers is configured to store a liquid, each inner container comprising an outlet to enable the liquid to be dispensed;

a connector assembly configured to be coupled to the beverage dispensing package, wherein the connector assembly comprises:

a plurality of connectors configured to couple to a respective outlet of the plurality of inner containers; and a dispensing line coupled to the plurality of connectors, wherein, when the connector assembly is coupled to the beverage dispensing package, the plurality of inner containers are coupled in flow communication with the dispensing line to enable the liquids within each of the inner containers to be jointly dispensed through the dispensing line;

wherein the beverage dispensing package further comprises an alignment plate with openings for receiving each outlet of the plurality of inner containers;

wherein the connector assembly further comprises a locking member that releasably engages the alignment plate; and wherein the connector assembly further comprises a holding plate and an actuator plate, wherein the locking member extends through a locking member opening defined in the holding plate and the actuator plate.

2. The beverage dispensing system of claim 1, wherein each inner container is formed of a collapsible material that enables each inner container to at least partially collapse when the liquid within the inner container is dispensed.

3. The beverage dispensing system of claim 1, wherein each outlet is separated from each other outlet such that the liquid storable within each inner container is separated from each other liquid until the connector assembly is coupled to the beverage dispensing package.

4. The beverage dispensing system of claim 1, wherein the connector assembly further comprises at least one spring member coupled to the holding plate and the actuator plate to bias the actuator plate and the holding plate away from the alignment plate when the connector assembly is coupled to the beverage dispensing package.

5. The beverage dispensing system of claim 4, wherein the locking member comprises at least one leg member that engages the alignment plate, and wherein the actuator plate is configured to disengage the locking member from the alignment plate when the actuator plate is moved towards the holding plate.

6. The beverage dispensing system of claim 4, wherein the at least one spring member further biases the holding plate away from the actuator plate.

7. The beverage dispensing system of claim 1, wherein at least one inner container of the plurality of inner containers or the beverage dispensing package includes a tag that encodes information relating to the contents of the at least one inner container or the beverage dispensing package.

8. The beverage dispensing system of claim 1, further comprising a removable cap for the outlet of each bag for use during transport.

9. The beverage dispensing system of claim 8, where the removable caps are connected together.

10. The beverage dispensing system of claim 9, where the removable caps are one of: (1) connected together via a connection mechanism and (2) affixed to a top cover of a box.

11. The beverage dispensing system of claim 1, wherein the plurality of connectors are unitarily formed within a single connector package.

12. The beverage dispensing system of claim 7, wherein the tag is one of a radio frequency identification (RFID) tag, a quick response (QR) tag, a barcode tag and a near field communication (NFC) tag.

13. The beverage dispensing system of claim 7, wherein each inner container has an associated tag.

14. The beverage dispensing system of claim 7, further comprising a tag reader for reading the contents of each tag.

15. The beverage dispensing system of claim 14, wherein the tag reader is connected to the connector assembly.

16. The beverage dispensing system of claim 14, further including a processor, the tag reader coupled to the processor, the processor configured to receive the contents of the tag from the tag reader and to determine if a connected container is correct.

17. The beverage dispensing system of claim 14, further including a processor, the tag reader coupled to the processor, the processor configured to determine if a new container is of a same type as a replaced container.

18. The beverage dispensing system of claim 14, further including a processor, the tag reader coupled to the processor, the processor configured to maintain a current volume of one of the containers and to reset the current volume when the one of the containers is replaced.

19. The beverage dispensing system of claim 18, wherein the processor is further configured to maintain a last date used for the one of the containers.

20. The beverage dispensing system of claim 7, wherein the encoded information includes one or more of the following: type of beverage in the container; alcohol content; brand name; age of content; production date; batch number; volume; unique identification number of the container; distributor of the container; and other suitable data.

* * * * *